US011542783B2

(12) United States Patent
Ross et al.

(10) Patent No.: US 11,542,783 B2
(45) Date of Patent: Jan. 3, 2023

(54) METHOD TO MANIPULATE A WELL USING AN UNDERBALANCED PRESSURE CONTAINER

(71) Applicant: METROL TECHNOLOGY LIMITED, Aberdeen (GB)

(72) Inventors: Shaun Compton Ross, Aberdeen (GB); Leslie David Jarvis, Stonehaven (GB)

(73) Assignee: METROL TECHNOLOGY LIMITED, Aberdeen (GB)

( * ) Notice: Subject to any disclaimer, the term of this patent is extended or adjusted under 35 U.S.C. 154(b) by 444 days.

(21) Appl. No.: 16/302,461

(22) PCT Filed: May 26, 2017

(86) PCT No.: PCT/GB2017/051515
§ 371 (c)(1),
(2) Date: Nov. 16, 2018

(87) PCT Pub. No.: WO2017/203285
PCT Pub. Date: Nov. 30, 2017

(65) Prior Publication Data

US 2019/0203567 A1 Jul. 4, 2019

(30) Foreign Application Priority Data

May 26, 2016 (GB) ..... 1609283

(51) Int. Cl.
*E21B 37/08* (2006.01)
*E21B 49/00* (2006.01)
(Continued)

(52) U.S. Cl.
CPC ..... *E21B 37/08* (2013.01); *E21B 49/008* (2013.01); *E21B 49/081* (2013.01);
(Continued)

(58) Field of Classification Search
CPC ..... E21B 37/08
See application file for complete search history.

(56) References Cited

U.S. PATENT DOCUMENTS 2,619,180 A 11/1952 Smith et al.
2,747,401 A * 5/1956 Doll ..... E21B 49/10 73/152.05

(Continued)

FOREIGN PATENT DOCUMENTS

CN 203531888 4/2014
DE 102010014415 12/2010

(Continued)

OTHER PUBLICATIONS

Examination Report for Corresponding Eurasian Application No. 201892741, dated Apr. 22, 2020.

(Continued)

*Primary Examiner* — Michael R Wills, III
*Assistant Examiner* — Neel Girish Patel
(74) *Attorney, Agent, or Firm* — Womble Bond Dickinson (US) LLP

(57) ABSTRACT

A method to manipulate a well comprising providing an apparatus (60) in a well (14) below a packer (22) or other annular sealing device, the apparatus comprising a container (68) having a volume of gas which is sealed at the surface and nm into the well, such that the pressure in the container (68) is at a lower pressure than the surrounding well. When the apparatus is below the packer, a wireless control signal, is sent to operate a valve assembly (62) to selectively allow fluid to enter the container whereby at least 50 litres of fluid is drawn into the container. In this way, the apparatus can be used independent of perforating guns, to clear perforations or other areas in the well or may be used for a variety of tests (Continued)

such as an interval test, drawdown test or a connectivity test such as a pulse or interference test.

19 Claims, 7 Drawing Sheets

(51) Int. Cl.
*E21B 49/08* (2006.01)
*E21B 21/08* (2006.01)
*E21B 49/10* (2006.01)

(52) U.S. Cl.
CPC ..... *E21B 49/088* (2013.01); *E21B 21/085* (2020.05); *E21B 49/0875* (2020.05); *E21B 49/10* (2013.01)

(56) References Cited

U.S. PATENT DOCUMENTS 3,020,961 A 2/1962 Orr
4,605,074 A 8/1986 Barfield
5,353,637 A 10/1994 Plumb
5,394,141 A 2/1995 Soulier
5,555,945 A 9/1996 Schultz
5,576,703 A 11/1996 MacLeod et al.
6,173,772 B1 1/2001 Vaynshteyn
6,343,650 B1 * 2/2002 Ringgenberg ..... E21B 33/128 166/250.17
6,347,666 B1 2/2002 Langseth
6,357,525 B1 3/2002 Langseth et al.
6,494,616 B1 12/2002 Tokhtuev et al.
6,955,216 B1 * 10/2005 Heijnen ..... E21B 27/02 166/100
8,215,164 B1 7/2012 Hussain et al.
2002/0020535 A1 * 2/2002 Johnson ..... E21B 49/08 166/363
2002/0066563 A1 * 6/2002 Langseth ..... E21B 49/081 166/264
2003/0056952 A1 3/2003 Stegemeier et al.
2004/0099418 A1 * 5/2004 Behrmann ..... E21B 21/00 166/312
2004/0104029 A1 6/2004 Martin
2004/0231842 A1 11/2004 Shammai
2005/0028973 A1 2/2005 Paluch
2005/0028974 A1 2/2005 Moody
2005/0077086 A1 * 4/2005 Vise, Jr. ..... E21B 47/06 175/59
2005/0194134 A1 * 9/2005 McGregor ..... E21B 49/06 166/264
2006/0225881 A1 10/2006 O'Shaughnessy et al.
2007/0162235 A1 * 7/2007 Zhan ..... G01V 1/40 702/6
2007/0236215 A1 10/2007 Innes et al.
2008/0066535 A1 3/2008 Vasques
2008/0066536 A1 3/2008 Goodwin et al.
2008/0156482 A1 7/2008 Gubar et al.
2009/0229813 A1 9/2009 Brink et al.
2010/0044044 A1 * 2/2010 Johnson ..... F42B 3/02 166/297
2010/0095758 A1 * 4/2010 Georgi ..... E21B 49/084 73/152.28
2010/0155054 A1 * 6/2010 Innes ..... E21B 27/02 166/165
2010/0242586 A1 * 9/2010 Elshahawi ..... E21B 33/1243 73/152.39
2011/0132609 A1 6/2011 Van Hal
2011/0158050 A1 6/2011 Merino et al.
2011/0174487 A1 7/2011 Burleson
2011/0198077 A1 * 8/2011 Kischkat ..... E21B 49/10 166/250.01
2011/0303409 A1 12/2011 Harrigan et al.
2012/0085540 A1 * 4/2012 Heijnen ..... E21B 27/02 166/305.1
2013/0068463 A1 * 3/2013 Landsiedel ..... E21B 33/1243 166/311
2013/0075109 A1 3/2013 Frisby et al.
2013/0133883 A1 5/2013 Hill
2013/0299165 A1 11/2013 Crow
2014/0041873 A1 2/2014 Lovik
2014/0311736 A1 10/2014 Pipchuk et al.
2014/0345103 A1 * 11/2014 Osaland ..... E21B 37/02 29/426.3
2015/0027696 A1 1/2015 Kim
2015/0159480 A1 6/2015 Kalyanaraman et al.
2015/0159484 A1 * 6/2015 Dumont ..... G01V 9/00 166/250.02
2015/0167442 A1 * 6/2015 Harfoushian ..... E21B 49/082 166/264
2015/0233773 A1 8/2015 Sale et al.
2015/0292288 A1 10/2015 Kasperski et al.
2015/0315895 A1 11/2015 Patel et al.
2015/0337629 A1 * 11/2015 Zhang ..... E21B 43/25 166/255.1
2015/0377019 A1 * 12/2015 Gleitman ..... E21B 49/006 166/250.01
2016/0024899 A1 * 1/2016 Lynn ..... E21B 43/255 166/305.1
2016/0123133 A1 5/2016 Leeflang et al.
2016/0168985 A1 * 6/2016 Betancourt-Pocaterra ..... E21B 49/005 73/152.04
2016/0265312 A1 * 9/2016 Holly ..... G05D 7/0676
2016/0376877 A1 * 12/2016 LaGrange ..... E21B 43/116 175/4.6
2017/0022809 A1 * 1/2017 Garcia ..... E21B 49/088
2017/0254198 A1 * 9/2017 Dybdahl ..... G01N 1/2035
2017/0328155 A1 * 11/2017 Richards ..... E21B 34/08

FOREIGN PATENT DOCUMENTS

EP 0953726 3/1999
EP 2192262 6/2010
EP 2886790 6/2015
GB 2522272 7/2015
WO 200301169 1/2003
WO 2003098176 11/2003
WO 2014022384 2/2014
WO 2014120988 8/2014
WO 2017203286 11/2017
WO 2017203287 11/2017
WO 2017203288 11/2017
WO 2017203290 11/2017
WO 2017203291 11/2017
WO 2017203292 11/2017
WO 2017203293 11/2017
WO 2017203294 11/2017
WO 2017203295 11/2017
WO 2017203296 11/2017

OTHER PUBLICATIONS

UKIPO Search Report dated Dec. 21, 2016 in corresponding GB Application No. GB1609283.5.
UKIPO Search Report dated Feb. 24, 2017 in corresponding GB Application No. GB1609283.5.
International Search Report and Written Opinion dated Sep. 7, 2017 in corresponding PCT Application No. PCT/GB2017/051515.
International Search Report for PCT/GB2017/051515, dated Aug. 28, 2017.
Schlumberger: "WellWatcher Flux, Multizonal reservoir monitoring system", 2016.
Copending International Application No. PCT/GB2017/051516 filed May 26, 2017.
Copending International Application No. PCT/GB2017/051517 filed May 26, 2017.
Copending International Application No. PCT/GB2017/051518 filed May 26, 2017.
Copending International Application No. PCT/GB2017/051520 filed May 26, 2017.

(56) References Cited

OTHER PUBLICATIONS

Copending International Application No. PCT/GB2017/051521 filed May 26, 2017.
Copending International Application No. PCT/GB2017/051522 filed May 26, 2017.
Copending International Application No. PCT/GB2017/051523 filed May 26, 2017.
Copending International Application No. PCT/GB2017/051524 filed May 26, 2017.
Copending International Application No. PCT/GB2017/051525 filed May 26, 2017.
Copending International Application No. PCT/GB2017/051526 filed May 26, 2017.
International Preliminary Report on Patentability for PCT/GB2017/051515, dated Jun. 4, 2018.
GCC Patent Office Examination Report for GC Application No. 2017/33464, dated May 31, 2020.
Office Action for Eurasian Application No. 201892741, dated Nov. 20, 2020.

* cited by examiner

METHOD TO MANIPULATE A WELL USING AN UNDERBALANCED PRESSURE CONTAINER

CROSS REFERENCE TO RELATED APPLICATIONS

This application is a 35 U.S.C. 371 National Stage of International Application No. PCT/GB2017/051515, titled "METHOD TO MANIPULATE A WELL USING AN UNDERBALANCED PRESSURE CONTAINER", filed May 26, 2017, which claims priority to GB Application No. 1609283.5, titled "METHOD TO MANIPULATE A WELL", filed May 26, 2016, all of which are incorporated by reference herein in their entirety.

This invention relates to a method to manipulate a well, particularly but not exclusively a shut-in well.

It is useful to know as much about a well and reservoir as possible, and monitor them, when they have been shut-in or plugged. This can provide useful information on the reservoir which can assist future recovery from neighbouring wells, and can also alert operators to potential problems.

A variety of tests can be conducted to determine well and reservoir characteristics. One connectivity test is a pulse test where a pressure pulse is sent from one well to another, and the relatively subtle pressure wave detected in the second well. It can then be inferred whether and to what extent the reservoir (or a particular zone) is open and allows pressure communication between these wells. This can be useful to determine the optimum strategy for extracting fluids from the reservoir.

Another connectivity test is an interference test which monitors longer term affects at an observation well following production (or injection) in a separate well, and useful data can also be obtained regarding the reservoir between the wells or zones, such as connectivity, permeability, and storage capacity.

The inventors of the present invention have noted that the pressure signal in the receiving well can be difficult to detect, especially when the well has been temporarily or permanently abandoned, and it includes a kill fluid, and especially when filter cake may be present.

It is known to fire perforating guns to open up the casing and formation for fluid flow. On occasion, debris is generated by this operation, and the debris can impede the flow of fluid into the well.

References herein to 'casing' includes 'liner' unless stated otherwise.

US2011 0174487 describes a perforating system which includes underbalance pulsations immediately following a perforating gun activation. Some cleaning of the debris is afforded by such a system, but it is inextricably connected to perforating gun activation. The inventors of the present invention have noted that further optimisation on the timing of the underbalance effects can be gained independent of gun activation, and indeed regardless of whether perforating guns are present or not.

Moreover embodiments of the present invention address further limitations of the state of the art over and above mitigating perforating gun debris.

Thus an object of the present invention is to mitigate one or more of the limitations of the state of the art.

According to one aspect of the present invention there is provided a method to manipulate a well, comprising:

providing a pressure sensor in the well;

providing an apparatus in a well below an annular sealing device, the annular sealing device engaging with an inner face of casing or wellbore in the well, and being at least 100 m below a surface of the well, providing a connector for connecting the apparatus to the annular sealing device, the connector being above the apparatus and below the annular sealing device;

the apparatus comprising:

a container having a volume of at least 50 litres;

a port to allow pressure and fluid communication between an inside and an outside of the container;

a mechanical valve assembly having a valve member adapted to move to selectively allow or resist fluid entry into at least a portion of the container, via the port;

a control mechanism to control the mechanical valve assembly, comprising a communication device configured to receive a control signal for moving the valve member;

optionally sealing the container at the surface, and then deploying it into the well such that the apparatus moves from the surface into the well below the annular sealing device with the container sealed;

the pressure in at least a portion of said inside of the container being less than said outside of the container for at least one minute;

sending a control signal from above the annular sealing device to the communication device at least in part by a wireless control signal transmitted in at least one of the following forms: electromagnetic, acoustic, inductively coupled tubulars and coded pressure pulsing;

moving the valve member in response to said control signal to allow fluid to enter the container; and, drawing in at least 5 litres of fluid into the container.

Said manipulation can reduce formation damage, that is at least partially unblock any blocked portions and/or clear portions of the well and/or surrounding formation; often sufficient to improve pressure connectivity between the well and formation. The inventors of the present invention have recognised that production rates, injection rates, effective testing and/or other well operations can be compromised by pores or other areas being blocked and that knowledge of the effectiveness of unblocking these areas is useful. These blockages may be caused by debris such as kill fluid mud filter cake, lost circulation material, or perforation debris. Thus 'debris' may include perforation debris and/or formation damage such as filter cake.

It can be difficult to control the pressure in the area below an annular sealing device between a casing/wellbore and an inner production tubing or test string, especially independent of the fluid column in the inner production tubing. Thus embodiments of the present invention can provide a degree of pressure control in this area, especially through the combination of the container and the wireless control.

The flow rate into the container is typically relatively fast, such as more than 1 or more than 5 litres per second. However, in use following the valve moving, the pressure in the container reduces as it equalises and consequently the flow rate reduces until the pressures are generally balanced (or for example the valve is closed). Nevertheless, typically the flow rate of at least 1 or at least 5 litres per second will be maintained for at least 0.5 seconds or perhaps more than 1 second or more than 2 seconds.

Given these relatively fast flow rates, the pressure is typically equalised (that is to within 100 psi) between inside of the container and outside the container within at most 40 seconds, or sooner such as at most 20 seconds or at most 10 seconds.

Normally, the valve member is moved in response to the control signal, at least 2 minutes before and/or at least 2 minutes after, any perforating gun activation. It may be at least 10 minutes before and/or after any perforating gun activation. Thus their independent control can elicit useful information between guns firing and the valve member moving. The performance of guns can then be assessed since the movement of the valve member is independent of the operation of the guns. For example, the effectiveness of the perforation could be assessed.

Indeed, there may be no perforation gun activation or no guns. Therefore such devices can work without perforating guns.

Communication path(s) can be perforations created in the well and surrounding formation by a perforating gun. In some cases, use of a perforating gun to provide communication path(s) is not required. For example the well may be open hole and/or it may include a screen/gravel packs, slotted sleeve or a slotted liner or has previously been perforated.

References to communication path(s) herein include all such examples where access to the formation is provided and is not limited to perforations created by perforating guns.

Thus whether perforating guns are present or not, such embodiments act independently of perforating guns' activation, which can allow more data to be collected on the nature of the well and/or reservoir. There can also be better control of the resulting "underbalance effect" from the lower pressure inside the container, due to the independent control from the guns. Additionally or alternatively, the activation, may improve the quality of the communication paths by for example "cleaning" the communication paths.

The invention also provides a method to gain data to determine condition(s) in a well or reservoir especially before and after manipulating the well by the method described above.

Container Options

The apparatus may be elongate in shape. It may be in the form of a pipe. It is normally cylindrical in shape.

Whilst the size of the container can vary, depending on the nature of the well, typically the container may have a volume of at least 50 litres (l), optionally at least 100 l. The container may have a volume of at most 3000 l, normally at most 1500 l, optionally at most 500 l.

Thus the apparatus may comprise a pipe/tubular (or a sub in part of a pipe/tubular) housing the container and other components, or indeed, the container may be made up of tubulars, such as tubing, drill pipe, liner, or casing joined together. The tubulars may comprise joints each with a length of from 3 m to 14 m, generally 8 m to 12 m, and nominal external diameters of from 2⅜" (or 2⅞") to 7".

As well as the mechanical valve assembly, the container may comprise a drain valve. For example this may be provided spaced away from the mechanical valve assembly to allow fluid therein to drain more readily when the apparatus is returning to surface.

Valve Options

The valve member may comprise a piston, especially a floating piston. Where the valve member comprises a piston, a separate control valve may be provided between two chambers.

The valve member can be controlled directly or indirectly. In certain embodiments, the valve member is driven directly by the control mechanism electro-mechanically or electro-hydraulically via porting. In other embodiments the valve is controlled indirectly by, for example, movement of a piston causing the valve to move.

The valve member may be at the port.

The valve member may be adapted to close the port in a first position, and open the port in a second position. Thus, normally, in the first position the valve member seals said inside of the container from said outside of the container, and normally, in the second position, the valve member allows fluid entry to the container. Thus, in the second position, pressure and fluid communication may be allowed between said inside of the container and said outside of the container.

The valve member may comprise a sleeve. Thus the apparatus may comprise a sleeve over or normally within a pipe or tubular, the pipe/tubular having a plurality of apertures which form the ports, which can be opened and closed by relative movement of the sleeve and pipe, for example rotation but preferably by relative longitudinal movement.

There may be less than ten ports, or less than five ports.

There may be a plurality of valve members, optionally controlling ports of different sizes or the valve members having different sizes themselves. Each different valve member may be independently controlled.

One valve member (for example a smaller one) may be opened, and the pressure change monitored, using information from a pressure gauge inside or outside of the apparatus, the second valve member (for example a larger one) may be opened, for example at an optimum time, and/or to an optimum extent based on information received from the pressure gauge.

The apparatus may comprise a choke.

The port provides a cross-sectional area for pressure and fluid communication. Said area may be least 0.1 $cm^2$, normally at least 0.25 $cm^2$, optionally at least 1 $cm^2$. The cross-sectional area may be at most 150 $cm^2$ or at most 25 $cm^2$, or at most 5 $cm^2$, optionally at most 2 $cm^2$. Thus such a cross-sectional area may form a choke to limit the rate of entry via the port.

The choke may be integrated with the mechanical valve assembly or it may be in a flowpath comprising the port and the mechanical valve assembly.

The pressure difference between the inside and outside of the container, the volume of container, and the cross sectional area and/or the choke may be configured such that the pressure drop after the valve opens is at least 100 psi, optionally at least 500 psi or at least 1000 psi. This can depend on well conditions e.g. reservoir pressure and permeability. In this way, any pre-existing formation damage may be mitigated.

Thus in contrast to distinct procedures on a well, where fluid displacement and pressure drop in the well are minimised, embodiments of the present invention are directed to create a pressure drop.

Where the valve comprises a piston, the cross-sectional area for fluid entry may be different, for example at least 16 $cm^2$, optionally at least 50 $cm^2$ or at least 100 $cm^2$. Normally it is at most 250 $cm^2$ or at most 200 $cm^2$.

Said cross-sectional area may comprise a filter.

The valve member may function as the choke, optionally an adjustable choke which can be varied in situ or it may be a fixed choke. Where a plurality of valve members are provided, multiple different sizes of chokes may be provided. The mechanical valve assembly can therefore comprise a variable valve member.

Thus the size of the cross-sectional area for fluid entry may be small enough, for example 0.1-0.25 $cm^2$, which effectively chokes the fluid entry.

More generally, the valve member may move again to the position in which it started, or to a further position, which may be a further open or further closed or partially open/closed position. This is normally in response to a further control signal being received by the communication device (or this may be an instruction in the original signal). Optionally therefore the valve member can move again to resist fluid entry to said inside of the container and from said outside of the container. For example, flow rate can be stopped or started again or changed, and optionally this may be part-controlled in response to a parameter or time delay. Normally the valve member in an open second position remains connected to the apparatus.

The valve may be closed before the pressure between the container and the well has balanced. The remaining pressure differential may optionally be utilised at a later time. Thus the procedure of opening the valve member to allow or resist fluid entry can be repeated at a later time.

For example, in order to draw in at least five litres of fluid into the well three litres may be drawn in and then the valve member moved to close the port, and then moved again to open the port for the remaining two litres or more.

The mechanical valve assembly comprises the solid valve member. The mechanical valve assembly normally has an inlet, a valve seat and a sealing mechanism. The seat and sealing mechanism may comprise a single component (e.g. pinch valve, or mechanically ruptured disc).

Suitable mechanical valve assemblies may be selected from the group consisting of: gate valves, ball valves, plug valves, regulating valves, cylindrical valves, piston valves, solenoid valves, diaphragm valves, disc valves, needle valves, pinch valves, spool valves, and sliding or rotating sleeves.

More preferred for the mechanical valve assembly of the present invention is a valve assembly which may be selected from the group consisting of gate valves, ball valves, plug valves, regulating valves, cylindrical valves, piston valves, solenoid valves, disc valves, needle valves, and sliding or rotating sleeves.

In particular, piston, needle and sleeve valve assemblies are preferred.

The valve assembly may incorporate a spring mechanism such that in one open position it functions as a variable pressure release valve.

The valve member may be actuated by at least one of a (i) motor & gear, (ii) spring, (iii) pressure differential, (iv) solenoid and (v) lead screw.

The mechanical valve assembly may be at one end of the apparatus. However it may be in its central body. One may be provided at each end.

The control mechanism may be configured to move the valve member to selectively allow or resist fluid entry into at least a portion of the container when a certain condition is met, e.g. when a certain pressure is reached e.g. 2000 psi or after a time delay. Thus the control signal causing the response of moving the valve member, may be conditional on certain parameters, and different control signals can be sent depending on suitable parameters for the particular well conditions.

Fluid Options

The container normally comprises fluid, normally gas for example, at least 85 vol % gas, such as nitrogen, carbon dioxide, or air. In one embodiment, fluid can be sealed in at least a portion (for example more than 50 vol %) of the container at atmospheric pressure before being deployed, and then the apparatus deployed in the well (which has a higher downhole pressure). Thus, the pressure in said portion of the container which has a pressure less than the outside of the container may be, before fluid entry, in the range of 14 to 25 psi, that is normal atmospheric pressure which has sometimes increased with the higher temperatures in the well.

Alternatively, the container may be effectively evacuated, that is at a pressure of less than 14 psi, optionally less than 10 psi.

The pressure difference between said portion of the inside of the container with a reduced pressure and said outside of the container before fluid entry is allowed may be at least 100 psi, preferably at least 1000 psi.

Well Tests

In one embodiment well fluids are drawn into the container, and in effect a small well test is conducted. This can provide useful information without going to the expense and time of conducting a full well test or closed chamber test.

Optionally a secondary container can be provided which can help clear the well, as described herein, before such a well test is conducted using the first container.

Secondary Containers

In addition to the container (sometimes referred to below as a 'primary container') there may be one or more secondary containers, optionally each with respective control devices controlling fluid communication between the inside of the respective secondary container and the outside of that container. This may be, for example, a surrounding portion of the well, or another portion of the apparatus or the formation.

The control devices of the secondary containers may include pumps, mechanical valves and/or latch assemblies.

A piston may be provided in one or more of the secondary containers. It may, for certain embodiments, function as the valve.

Alternatively, a floating piston may be controlled indirectly by the control device such as the valve. In some embodiments, the piston may be directly controlled by the latch assembly.

The latch assembly can control the floating piston—it can hold the floating piston in place against action of other forces (e.g. well pressure) and is released in response to an instruction from the control mechanism.

Thus a secondary container can have a mechanical valve assembly (such as those described herein) or latch assembly, or a pump which regulates fluid communication between said inside of that secondary container and said outside of that secondary container. The control device may or may not be provided at a port.

Thus there may be one, two, three or more than three secondary containers. The further control devices for the secondary containers may or may not move in response to a control signal, but may instead respond based on a parameter or time delay. Each control device for the respective secondary container can be independently operable. A common communication device may be used for sending a control signal to a plurality of control devices.

The contents of the containers may or may not be miscible at the outlet. For example one container can have a polymer and a second container a cross linker, when mixed, in use, in the well form a gel or otherwise set/cure. The containers can be configured differently, for example have different volumes or chokes etc.

The containers may have a different internal pressure compared to the pressure outside of the container such as the surrounding portion of the well or the formation. If less than the outside of the container, as described more generally herein, they are referred to as 'underbalanced' and when more than the outside of the container they are referred to as 'overbalanced'.

Thus (an) underbalanced or overbalanced secondary container(s) and associated secondary port and control device may be provided, the secondary container(s) each preferably having a volume of at least five litres and, in use, having a pressure lower/higher than the outside of the container normally for at least one minute, before the control device is activated optionally in response to the control signal. Fluids surrounding the secondary container can thus be drawn in (for underbalanced containers), optionally quickly, or fluids expelled (for overbalanced containers).

Thus, a plurality of primary and/or secondary containers or apparatus may be provided each having different functions, the primary container being underbalanced, one or more secondary containers may be overbalanced and one or more secondary containers may be controlled by a pump.

This can be useful, for example, to partially clear a filter cake using an underbalanced container, before deploying an acid treatment onto the perforations using the container controlled by a pump.

Alternatively, for a short interval manipulation, a skin barrier could be removed from the interval by acid deployed from an overbalanced container and then the apparatus with an underbalanced container used to draw fluid from the interval.

Fluid from a first chamber within the container can go into another to mix before being released/expelled.

The port may include a non-return valve which can resist fluid release from the container.

Tests

The method described herein may be used to conduct an interval test, drawdown test, flow test, build-up test, pressure test, or connectivity tests such as a pulse or an interference test. Sensors optionally record the pressure during such a test.

A pulse test is where a pressure pulse is induced in a formation at one well/isolated section of the well and detected in another "observing" well or separate isolated section of the same well, and whether and to what extent a pressure wave is detected in the observing well or isolated section, provides useful data regarding the pressure connectivity of the reservoir between the wells/isolated sections. Such information can be useful for a number of reasons, such as to determine the optimum strategy for extracting fluids from the reservoir.

An interference test is similar to a pulse test, though monitors longer term effects at an observation well/isolated section following production (or injection) in a separate well or isolated section.

For such connectivity tests, the well being manipulated according to embodiments of the present invention is the observing well/isolated section. Thus the method described herein may include observing for pressure changes in the well as part of a connectivity test.

For certain embodiments however, the method of manipulating the well may be the well—particularly the isolated section—from where pulses are sent using the apparatus. For example, in a multi-lateral well, the apparatus may send a pressure pulse from one side-track of the same well to another. Side tracks (or the main bore) of wells which are isolated from each other are defined herein as separate isolated sections.

When the valve member is moved in response to the control signal to allow for fluid entry, there is, for certain embodiments, a (preferably sudden) drawdown in pressure, which can clear debris, such as perforation debris, filter cake and/or lost circulation material, from the well in the vicinity of the communication paths/formation. Optionally some of the debris, for example filter cake, may enter the container. Moreover, perforating debris may also be cleared.

In alternative embodiments, the well fluid is allowed to flow into the container gradually over several seconds (such as 5-10 seconds), or longer (such as 2 minutes-6 hours) or even very slow (such as 1-2 days), rather than less than a second. Choke functionality is therefore particularly useful.

Floating Piston

Moreover, for certain embodiments, the valve member may be a floating piston and is thus configured to allow or resist fluid entry into the container. Normally the floating piston has a dynamic seal against an inside of the container. The container may include two sections referred to as a dump chamber and a fluid chamber. For such embodiments, the dump chamber is normally the portion of the container having a pressure less than said outside of the container for at least one minute.

The floating piston can separate two sections in the fluid chamber, one section in fluid communication with the port and another section on an opposite side of the floating piston, in communication with the dump chamber.

Thus one side of the floating piston may be exposed to the well pressure via the port. Before effectively opening the port by moving the floating piston, a restraining mechanism is provided. Oftentimes, this includes a fluid, such as oil, in the fluid chamber on the dump chamber side of the floating piston. A control valve, choke and/or pump is normally provided to control fluid communication between the fluid chamber and the dump chamber. Alternatively the restraining mechanism may be a latching mechanism to hold the floating piston in position against the force of the well pressure, until it is activated to move.

Thus in response to the control signal the control mechanism can control the restraining mechanism and the floating piston moves which allows fluid entry to the container (fluid chamber section) from outside the container e.g. the well, to draw fluids therein.

In one embodiment therefore, when instructed by the wireless signal, the restraining mechanism between the fluid chamber and dump chamber may allow fluid flow from the fluid chamber into the dump chamber, driven by the action of the well pressure on the floating piston, thus allowing well fluids into the fluid chamber. For certain embodiments, a choke may be provided between the fluid chamber and the dump chamber to regulate movement of the floating piston which controls the ingress of fluids into the fluid chamber from the well.

A non-return valve may be provided in the port.

The dump chamber may have at least 90% of the volume of that of the fluid chamber but preferably the dump chamber has a volume greater than the volume of the fluid chamber to avoid or mitigate pressure build-up within the dump chamber and hence achieve a more uniform flow rate into the fluid chamber. The dump chamber may consist of gas, optionally at approximately atmospheric pressure, or may be partially evacuated.

Short Interval

The method to manipulate the well according to the first, or a second aspect (detailed below) of the invention, may include a method of conducting a short interval test and so position the port between two portions of one or more annular sealing device(s), which between them define a short interval. The valve member can be moved in response to the control signal to expose the pressure in the container to the adjacent well/reservoir.

According to a second aspect of the present invention there is provided a method to manipulate a well by conducting a short interval test, comprising:

providing a pressure sensor in the well;

providing an apparatus in the well, the apparatus comprising a container having a volume of at least 5 litres and a port to allow pressure and fluid communication between a portion of an inside of the container and an outside of container;

the port of the apparatus being below a first portion of a packer element and above a second portion of a or the packer element, said portions spaced apart from each other by up to 10 m thus defining a short interval, and each engaging with an inner face of casing or wellbore in the well, and being at least 100 m below a surface of the well;

the short interval including at least one communication path between the well and the formation;

the apparatus further comprising:

a mechanical valve assembly having a valve member adapted to move to selectively allow or resist fluid entry into at least a portion of the container, via the port;

a control mechanism comprising a communication device configured to receive a control signal for moving the valve member;

deploying the apparatus into the well on a tubular, the pressure in at least a portion of an inside of the container being less than an outside of the container for at least one minute;

sending a control signal from outwith the short interval to the control mechanism at least in part by a wireless control signal transmitted in at least one of the following forms: electromagnetic, acoustic, inductively coupled tubulars and coded pressure pulsing;

moving the valve member in response to said control signal to allow fluid to enter the container; and, drawing in at least 5 litres of fluid into the container from the well.

In alternative embodiments, rather than a reduced pressure in said inside of the container compared to said outside of the container, a pump can be used in place of the mechanical valve assembly in order to draw fluids into the container. Further embodiments have both options.

The short interval may be defined by one packer element shaped to seal a (relatively small) interval formed from a recess within, or the shape of, the overall packer element. Thus for such embodiments, said first and second portions of a packer element belong to the same packer element, for example a single circular packer element. A first packer may therefore include the first and second portions of the packer element.

In other embodiments, the short interval is defined between packer elements such as a packer element described more generally herein above, and a further packer element. For such embodiments said first and second portions of packer elements are separate packer elements. For such embodiments, a first packer may therefore include the first portion of the packer element, and a second packer may include said second portion, which is a different packer element.

Thus there can be a second packer element where at least the port of the apparatus is positioned above the second packer element. The entire apparatus may be positioned above said second packer element. The second packer element may be wirelessly controlled. Thus it may be expandable and/or retractable in response to wireless signals. Thus in contrast with the first aspect of the invention, the port of the apparatus in the second aspect is below the first packer element (a form of annular sealing device) whereas in the first aspect of the invention the apparatus is below the annular sealing device.

The short interval, i.e. the distance between two annular sealing devices, may be less than 10 m, optionally less than 5 m or less than 2 m, less than 1 m, or less than 0.5 m. These distances are taken from the lowermost point of the first packer element, and the uppermost point of the second packer element. Thus this can limit the volume and so the apparatus is more effective when the port is exposed to the limited volume.

The wireless signal may be sent from outwith the short interval to the control mechanism entirely in its said wireless form.

Inflatable packers may comprise said packer elements especially for openhole applications. For such openhole applications, the packer elements used in the short interval test may be relatively long, that is 1-10 m, optionally 3-8 m. This is because the pressure drop in formation may cause flow around the packer element. Increasing the length of the packer elements reduces the risk of this occurring.

Sensors optionally record the pressure especially of the formation for example at the port or outside the apparatus.

One or both of the packer element(s) may be part of an annular sealing device described more generally herein.

The packer(s) may be resettable, so that it/they may be set in a first position and a first test may be performed, then disengaged, moved and reset in a different position, where a second test may be performed. Such a procedure is especially suitable in an openhole section of the well.

The packer(s) used in a short interval manipulation may also be deployed as part of a drill stem test (DST) string. For example, when performing a drill stem test, a short interval test may be conducted in a section of the well above or below the section being tested in the DST.

Where space permits, a perforating device such as a perforating gun may be provided in the short interval. This short interval manipulation is also particularly suitable to being performed in an openhole section.

In order to conduct a short interval test, at least one packer is preferably deployed on a tubular, such as drill pipe, casing and optionally coiled tubing.

Thus, the apparatus may be part of a string which includes a drill bit. The packer(s) may be mounted on said string, and activated to engage with an outer well casing or wellbore.

There may be a connector, as described herein more generally, for connecting the apparatus to the first packer, the connector being above the apparatus and below the first packer element.

The outside of the container according to the second aspect of the invention may be a surrounding portion of the well between the first and second portions of the packer element(s).

The method described herein may be used to conduct a permeability, a flow, pressure, or similar test/manipulation.

In one embodiment, the well may be manipulated by conducting a flow test. Flow from the reservoir is produced into said defined short interval, and proceeds through the apparatus. The resulting pump rate can be used to control and/or estimate the flow rate from the reservoir.

After pressure and fluid communication between the inside and the outside of the container has been allowed, conducting a build-up test can provide information on reservoir boundaries.

Optional features described above with respect to the first aspect of the invention are optional features with respect to the second aspect of the invention. For example, a floating piston and dump chamber are especially useful in embodiments in accordance with the second aspect of the invention. For example the container having volumes of at least 50 litres (l), optionally at least 100 l and optionally a volume of at most 3000 l, normally at most 1500 l, optionally at most 500 l.

Pump Addition

The apparatus may comprise an electrical pump to direct fluids from said inside of the container to said outside of the container. Thus fluid may be drawn into the container as described further above and then expelled from the container using the pump, optionally recharging the underbalance of pressure inside the container i.e. reducing the container pressure compared to outside the container. This recharged underbalanced container can be activated again.

Thus especially for the short interval test embodiment, the apparatus may further comprise an exhaust port in fluid communication with the container, and the exhaust port is positioned below the second annular sealing device or above the first (upper) annular sealing device, and the pump can expel fluids outwith the short interval through said exhaust port.

The electrical pump is preferably a positive displacement pump such as a piston pump, gear type pump, screw pump, diaphragm, and lobe pump; especially a piston or gear pump. Alternatively the pump may be a velocity pump such as a centrifugal pump. The electrical pump may drive another pump which in turn moves the fluid from inside the container to outside the container. This second pump need not be electrical; rather the 'prime mover' is electrical.

In any case, the pump can pump the fluid directly i.e. the fluid moving from inside the container to outside the container; or indirectly i.e. an intermediate fluid which acts on the fluid moving from inside the container to outside the container indirectly, for example via a floating piston. Thus embodiments with a dump chamber and floating piston are particularly suited to including a pump.

Signals

The wireless control signal is transmitted in at least one of the following forms: electromagnetic, acoustic, inductively coupled tubulars and coded pressure pulsing and references herein to "wireless" relate to said forms, unless where stated otherwise.

The communication device may comprise a wireless communication device. In alternative embodiments, the communication device is a wired communication device and the wireless signal transmitted in other parts of the well.

Coded Pressure Pulses

Pressure pulses include methods of communicating from/to within the well/borehole, from/to at least one of a further location within the well/borehole, and the surface of the well/borehole, using positive and/or negative pressure changes, and/or flow rate changes of a fluid in a tubular and/or annular space.

Coded pressure pulses are such pressure pulses where a modulation scheme has been used to encode commands within the pressure or flow rate variations and a transducer is used within the well/borehole to detect and/or generate the variations, and/or an electronic system is used within the well/borehole to encode and/or decode commands. Therefore, pressure pulses used with an in-well/borehole electronic interface are herein defined as coded pressure pulses. An advantage of coded pressure pulses, as defined herein, is that they can be sent to electronic interfaces and may provide greater data rate and/or bandwidth than pressure pulses sent to mechanical interfaces.

Where coded pressure pulses are used to transmit control signals, various modulation schemes may be used such as a pressure change or rate of pressure change, on/off keyed (OOK), pulse position modulation (PPM), pulse width modulation (PWM), frequency shift keying (FSK), pressure shift keying (PSK), amplitude shift keying (ASK), combinations of modulation schemes may also be used, for example, OOK-PPM-PWM. Data rates for coded pressure modulation schemes are generally low, typically less than 10 bps, and may be less than 0.1 bps.

Coded pressure pulses can be induced in static or flowing fluids and may be detected by directly or indirectly measuring changes in pressure and/or flow rate. Fluids include liquids, gasses and multiphase fluids, and may be static control fluids, and/or fluids being produced from or injected in to the well.

Signals—General

Preferably the wireless signals are such that they are capable of passing through a barrier, such as a plug or said annular sealing device, when fixed in place, and therefore preferably able to pass through the isolating components. Preferably therefore the wireless signals are transmitted in at least one of the following forms: electromagnetic, acoustic, and inductively coupled tubulars.

The signals may be data or control signals which need not be in the same wireless form. Accordingly, the options set out herein for different types of wireless signals are independently applicable to data and control signals. The control signals can control downhole devices including sensors. Data from sensors may be transmitted in response to a control signal. Moreover data acquisition and/or transmission parameters, such as acquisition and/or transmission rate or resolution, may be varied using suitable control signals.

EM/Acoustic and coded pressure pulsing use the well, borehole or formation as the medium of transmission. The EM/acoustic or pressure signal may be sent from the well, or from the surface. If provided in the well, an EM/acoustic signal can travel through any annular sealing device, although for certain embodiments, it may travel indirectly, for example around any annular sealing device.

Electromagnetic and acoustic signals are especially preferred—they can transmit through/past an annular sealing device or annular barrier without special inductively coupled tubulars infrastructure, and for data transmission, the amount of information that can be transmitted is normally higher compared to coded pressure pulsing, especially data from the well.

Therefore, the communication device may comprise an acoustic communication device and the wireless control signal comprises an acoustic control signal and/or the communication device may comprise an electromagnetic communication device and the wireless control signal comprises an electromagnetic control signal.

Similarly the transmitters and receivers used correspond with the type of wireless signals used. For example an acoustic transmitter and receiver are used if acoustic signals are used.

Where inductively coupled tubulars are used, there are normally at least ten, usually many more, individual lengths of inductively coupled tubular which are joined together in use, to form a string of inductively coupled tubulars. They have an integral wire and may be formed tubulars such as tubing drill pipe or casing. At each connection between adjacent lengths there is an inductive coupling. The inductively coupled tubulars that may be used can be provided by N O V under the brand Intellipipe®.

Thus, the EM/acoustic or pressure wireless signals can be conveyed a relatively long distance as wireless signals, sent for at least 200 m, optionally more than 400 m or longer which is a clear benefit over other short range signals. Embodiments including inductively coupled tubulars provide this advantage/effect by the combination of the integral wire and the inductive couplings. The distance travelled may be much longer, depending on the length of the well.

The control signal, and optionally other signals, may be sent in wireless form from above the annular sealing device to below the annular sealing device. Likewise signals may be sent from below the annular sealing device to above the annular sealing device in wireless form.

Data and commands within the signal may be relayed or transmitted by other means. Thus the wireless signals could be converted to other types of wireless or wired signals, and optionally relayed, by the same or by other means, such as hydraulic, electrical and fibre optic lines. In one embodiment, the signals may be transmitted through a cable for a first distance, such as over 400 m, and then transmitted via acoustic or EM communications for a smaller distance, such as 200 m. In another embodiment they are transmitted for 500 m using coded pressure pulsing and then 1000 m using a hydraulic line.

Thus whilst non-wireless means may be used to transmit the signal in addition to the wireless means, preferred configurations preferentially use wireless communication. Thus, whilst the distance travelled by the signal is dependent on the depth of the well, often the wireless signal, including relays but not including any non-wireless transmission, travel for more than 1000 m or more than 2000 m. Preferred embodiments also have signals transferred by wireless signals (including relays but not including non-wireless means) at least half the distance from the surface of the well to the apparatus.

Different wireless signals may be used in the same well for communications going from the well towards the surface, and for communications going from the surface into the well.

Thus, the wireless signal may be sent to the communication device, directly or indirectly, for example making use of in-well relays above and/or below any annular sealing device. The wireless signal may be sent from the surface or from a wireline/coiled tubing (or tractor) run probe at any point in the well above any annular sealing device. For certain embodiments, the probe may be positioned relatively close to any annular sealing device for example less than 30 m therefrom, or less than 15 m.

Acoustic

Acoustic signals and communication may include transmission through vibration of the structure of the well including tubulars, casing, liner, drill pipe, drill collars, tubing, coil tubing, sucker rod, downhole tools; transmission via fluid (including through gas), including transmission through fluids in uncased sections of the well, within tubulars, and within annular spaces; transmission through static or flowing fluids; mechanical transmission through wireline, slickline or coiled rod; transmission through the earth; transmission through wellhead equipment. Communication through the structure and/or through the fluid are preferred.

Acoustic transmission may be at sub-sonic (<20 Hz), sonic (20 Hz-20 kHz), and ultrasonic frequencies (20 kHz-2 MHz). Preferably the acoustic transmission is sonic (20 Hz-20 khz).

The acoustic signals and communications may include Frequency Shift Keying (FSK) and/or Phase Shift Keying (PSK) modulation methods, and/or more advanced derivatives of these methods, such as Quadrature Phase Shift Keying (QPSK) or Quadrature Amplitude Modulation (QAM), and preferably incorporating Spread Spectrum Techniques. Typically they are adapted to automatically tune acoustic signalling frequencies and methods to suit well conditions.

The acoustic signals and communications may be unidirectional or bi-directional. Piezoelectric, moving coil transducer or magnetostrictive transducers may be used to send and/or receive the signal.

EM

Electromagnetic (EM) (sometimes referred to as Quasi-Static (QS)) wireless communication is normally in the frequency bands of: (selected based on propagation characteristics) sub-ELF (extremely low frequency)<3 Hz (normally above 0.01 Hz);

ELF 3 Hz to 30 Hz;

SLF (super low frequency) 30 Hz to 300 Hz;

ULF (ultra low frequency) 300 Hz to 3 kHz; and,

VLF (very low frequency) 3 kHz to 30 kHz.

An exception to the above frequencies is EM communication using the pipe as a wave guide, particularly, but not exclusively when the pipe is gas filled, in which case frequencies from 30 kHz to 30 GHz may typically be used dependent on the pipe size, the fluid in the pipe, and the range of communication. The fluid in the pipe is preferably non-conductive. U.S. Pat. No. 5,831,549 describes a telemetry system involving gigahertz transmission in a gas filled tubular waveguide.

Sub-ELF and/or ELF are preferred for communications from a well to the surface (e.g. over a distance of above 100 m). For more local communications, for example less than 10 m, VLF is preferred. The nomenclature used for these ranges is defined by the International Telecommunication Union (ITU).

EM communications may include transmitting communication by one or more of the following: imposing a modulated current on an elongate member and using the earth as return; transmitting current in one tubular and providing a return path in a second tubular; use of a second well as part of a current path; near-field or far-field transmission; creating a current loop within a portion of the well metalwork in order to create a potential difference between the metalwork and earth; use of spaced contacts to create an electric dipole transmitter; use of a toroidal transformer to impose current in the well metalwork; use of an insulating sub; a coil antenna to create a modulated time varying magnetic field for local or through formation transmission; transmission within the well casing; use of the elongate member and earth as a coaxial transmission line; use of a tubular as a wave guide; transmission outwith the well casing.

Especially useful is imposing a modulated current on an elongate member and using the earth as return; creating a current loop within a portion of the well metalwork in order to create a potential difference between the metalwork and earth; use of spaced contacts to create an electric dipole transmitter; and use of a toroidal transformer to impose current in the well metalwork.

To control and direct current advantageously, a number of different techniques may be used. For example one or more of: use of an insulating coating or spacers on well tubulars; selection of well control fluids or cements within or outwith tubulars to electrically conduct with or insulate tubulars; use of a toroid of high magnetic permeability to create inductance and hence an impedance; use of an insulated wire, cable or insulated elongate conductor for part of the transmission path or antenna; use of a tubular as a circular waveguide, using SHF (3 GHz to 30 GHz) and UHF (300 MHz to 3 GHz) frequency bands.

Suitable means for receiving the transmitted signal are also provided, these may include detection of a current flow; detection of a potential difference; use of a dipole antenna; use of a coil antenna; use of a toroidal transformer; use of a Hall effect or similar magnetic field detector; use of sections of the well metalwork as part of a dipole antenna.

Where the phrase "elongate member" is used, for the purposes of EM transmission, this could also mean any elongate electrical conductor including: liner; casing; tubing or tubular; coil tubing; sucker rod; wireline; drill pipe; slickline or coiled rod.

A means to communicate signals within a well with electrically conductive casing is disclosed in U.S. Pat. Nos. 5,394,141 by Soulier and 5,576,703 by MacLeod et al both of which are incorporated herein by reference in their entirety. A transmitter comprising oscillator and power amplifier is connected to spaced contacts at a first location inside the finite resistivity casing to form an electric dipole due to the potential difference created by the current flowing between the contacts as a primary load for the power amplifier. This potential difference creates an electric field external to the dipole which can be detected by either a second pair of spaced contacts and amplifier at a second location due to resulting current flow in the casing or alternatively at the surface between a wellhead and an earth reference electrode.

Relay

A relay comprises a transceiver (or receiver) which can receive a signal, and an amplifier which amplifies the signal for the transceiver (or a transmitter) to transmit it onwards.

There may be at least one relay. The at least one relay (and the transceivers or transmitters associated with the apparatus or at the surface) may be operable to transmit a signal for at least 200 m through the well. One or more relays may be configured to transmit for over 300 m, or over 400 m.

For acoustic communication there may be more than five, or more than ten relays, depending on the depth of the well and the position of the apparatus.

Generally, less relays are required for EM communications. For example, there may be only a single relay. Optionally therefore, an EM relay (and the transceivers or transmitters associated with the apparatus or at the surface) may be configured to transmit for over 500 m, or over 1000 m.

The transmission may be more inhibited in some areas of the well, for example when transmitting across a packer. In this case, the relayed signal may travel a shorter distance.

However, where a plurality of acoustic relays are provided, preferably at least three are operable to transmit a signal for at least 200 m through the well.

For inductively coupled tubulars, a relay may also be provided, for example every 300-500 m in the well.

The relays may keep at least a proportion of the data for later retrieval in a suitable memory means.

Taking these factors into account, and also the nature of the well, the relays can therefore be spaced apart accordingly in the well.

The control signals may cause, in effect, immediate activation, or may be configured to activate the apparatus after a time delay, and/or if other conditions are present such as a particular pressure change.

Electronics

The apparatus may comprise at least one battery optionally a rechargeable battery. The battery may be at least one of a high temperature battery, a lithium battery, a lithium oxyhalide battery, a lithium thionyl chloride battery, a lithium sulphuryl chloride battery, a lithium carbon-monofluoride battery, a lithium manganese dioxide battery, a lithium ion battery, a lithium alloy battery, a sodium battery, and a sodium alloy battery. High temperature batteries are those operable above 85° C. and sometimes above 100° C. The battery system may include a first battery and further reserve batteries which are enabled after an extended time in the well. Reserve batteries may comprise a battery where the electrolyte is retained in a reservoir and is combined with the anode and/or cathode when a voltage or usage threshold on the active battery is reached.

The control mechanism is normally an electronic control mechanism. The communication device is normally an electronic communication device.

The battery and optionally elements of the control electronics may be replaceable without removing tubulars. They may be replaced by, for example, using wireline or coiled tubing. The battery may be situated in a side pocket.

The apparatus, especially the control mechanism, preferably comprises a microprocessor. Electronics in the apparatus, to power various components such as the microprocessor, control and communication systems, and optionally the valve, are preferably low power electronics. Low power electronics can incorporate features such as low voltage microcontrollers, and the use of 'sleep' modes where the majority of the electronic systems are powered off and a low frequency oscillator, such as a 10-100 kHz, for example 32 kHz, oscillator used to maintain system timing and 'wake-up' functions. Synchronised short range wireless (for example EM in the VLF range) communication techniques can be used between different components of the system to minimize the time that individual components need to be kept 'awake', and hence maximise 'sleep' time and power saving.

The low power electronics facilitates long term use of various components of the apparatus. The control mechanism may be configured to be controllable by the control signal up to more than 24 hours after being run into the well, optionally more than 7 days, more than 1 month, or more than 1 year or up to 5 years. It can be configured to remain dormant before and/or after being activated.

Sensors

The apparatus and/or the well (above and/or especially below the annular sealing device) may comprise at least one pressure sensor. The pressure sensor may be below the annular sealing device and may or may not form part of the apparatus. It can be coupled (physically or wirelessly) to a wireless transmitter and data can be transmitted from the wireless transmitter to above the annular sealing device or otherwise towards the surface. Data can be transmitted in at least one of the following forms: electromagnetic, acoustic, inductively coupled tubulars especially acoustic and/or electromagnetic as described herein above.

Such short range wireless coupling may be facilitated by EM communication in the VLF range.

Optionally the apparatus comprises a volume or level indicator such as an empty/full indicator or a proportional indicator arranged to determine the volume or level of fluid in the container.

A means to recover the data from the volume indicator is also normally included. The apparatus may comprise a pressure gauge, arranged to measure internal pressure in the container. The communication device may be configured to send signals from the pressure gauge wirelessly.

More generally, the apparatus and/or the well (above and/or especially below the annular sealing device) may comprise the pressure sensor.

Preferably at least temperature and pressure sensors are provided. A variety of sensors may be provided, including acceleration, vibration, torque, movement, motion, radiation, noise, magnetism, corrosion; chemical or radioactive tracer detection; fluid identification such as hydrate, wax and sand production; and fluid properties such as (but not limited to) flow, density, water cut, for example by capacitance and conductivity, pH and viscosity. Furthermore the sensors may be adapted to induce the signal or parameter detected by the incorporation of suitable transmitters and mechanisms. The sensors may also sense the status of other parts of the apparatus or other equipment within the well, for example valve member position or motor rotation.

Following operation of the device, data from the pressure sensor, and optionally other sensors, may be used, at least in part, to determine whether to conduct or how to better optimise at least one of a hydraulic fracturing operation, a well test, and a well/reservoir treatment, such as an acid treatment, on the well.

The data may show that the initial clean up flow from the well, after perforation but before normal production starts, may be shortened, or may not be necessary. This can be useful to obviate an unnecessary step.

An array of discrete temperature sensors or a distributed temperature sensor can be provided (for example run in) with the apparatus. Optionally therefore it may be below the annular sealing device. These temperature sensors may be contained in a small diameter (e.g. ¼") tubing line and may be connected to a transmitter or transceiver. If required any number of lines containing further arrays of temperature sensors can be provided. This array of temperature sensors and the combined system may be configured to be spaced out so the array of temperature sensors contained within the tubing line may be aligned across the formation, for example the communication paths; either for example generally parallel to the well, or in a helix shape.

The array of discrete temperature sensors may be part of the apparatus or separate from it.

The temperature sensors may be electronic sensors or may be a fibre optic cable.

Therefore in this situation the additional temperature sensor array could provide data from the communication path interval(s) and indicate if, for example, communication paths are blocked/restricted. The array of temperature sensors in the tubing line can also provide a clear indication of fluid flow, particularly when the apparatus is activated. Thus for example, more information can be gained on the response of the communication paths—an upper area of communication paths may have been opened and another area remain blocked and this can be deduced by the local temperature along the array of the temperature sensors.

Moreover, for certain embodiments, multiple longitudinally spaced containers are activated sequentially, and the array of temperature sensors used to assess the resulting flow from communication paths.

Data may be recovered from the pressure sensor(s), before, during and/or after the valve member is moved in response to the control signal. Recovering data means retrieving the data to the surface.

Data may be recovered from the pressure sensor(s), before, during and/or after a perforating gun has been activated in the well.

The data recovered may be real-time/current data and/or historical data.

Data may be recovered by a variety of methods. For example it may be transmitted wirelessly in real time or at a later time, optionally in response to an instruction to transmit.

Or the data may retrieved by a probe run into the well on wireline/coiled tubing or a tractor; the probe can optionally couple with the memory device physically or wirelessly.

Memory

The apparatus especially the sensors, may comprise a memory device which can store data for recovery at a later time. The memory device may also, in certain circumstances, be retrieved and data recovered after retrieval.

The memory device may be configured to store information for at least one minute, optionally at least one hour, more optionally at least one week, preferably at least one month, more preferably at least one year or more than five years.

The memory device may be part of sensor(s). Where separate, the memory device and sensors may be connected together by any suitable means, optionally wirelessly or physically coupled together by a wire. Inductive coupling is also an option. Short range wireless coupling may be facilitated by EM communication in the VLF range.

Other Apparatus Options

In addition to the wireless signal, the apparatus may include pre-programmed sequences of actions, e.g. a valve opening and re-closing, or a change in valve member position; based on parameters e.g. time, pressure detected or not detected or detection of particular fluid or gas. For example, under certain conditions, the apparatus will perform certain steps sequentially—each subsequent step following automatically. This can be beneficial where a delay to wait for a signal to follow on could mitigate the usefulness of the operation.

The apparatus may have a mechanism to orientate it rotationally.

Normally the port is provided on a side face of the apparatus although certain embodiments can have the port provided in an end face.

Barrier Test

The apparatus may be provided below a barrier (such as certain annular sealing devices described herein) and above a lower barrier, and the well manipulated such that a pressure test carried out between the barriers by drawing fluid into the container, thus removing fluid from the well. The decreased pressure caused by fluid being removed from between the barriers, stresses the barriers and so can be used to test the lower barrier.

Thus, for some methods, there need not be communication between the formation and the well. For example a pressure test may be conducted in a closed area in the well, for example between barriers or annular sealing devices, i.e. there being no communication paths in the well between the barriers or two annular sealing devices and the adjacent formation.

For example, a lower barrier bridge or cement plug is typically installed in a well to act as a primary barrier to the reservoir and is exposed, on its lower side, to reservoir pressure. Then a short distance above is a secondary barrier, often another bridge plug or cement plug.

Such a primary barrier can be tested from thereabove in accordance with the procedures set out herein.

The apparatus may hang off the secondary barrier.

The secondary barrier can be set after the apparatus is deployed into the well and charged.

One or more secondary containers, described herein above, may be provided having an overbalance of pressure. This may be used to test the secondary barrier from below, or to replace, at least in part, the volume of fluid removed from the section between the two barriers after a test which removed fluid has been completed.

A discrete temperature array may be deployed in the section between the barriers, or in a ring or helix above or below the barriers to assist in identifying the location of any leak detected.

In certain embodiments, the apparatus can be used to disrupt, inhibit and/or reverse the settling out and partial solidification of well fluids in parts of the well, especially the annulus.

Annular Sealing Device

The annular sealing device may be at least 300 m from the surface of the well. The surface of the well is the top of the uppermost casing of the well.

The annular sealing device is a device which seals between two tubulars (or a tubular and the wellbore), such as a packer element or a polished bore and seal assembly.

The packer element may be part of a packer, bridge plug, or liner hanger, especially a packer or bridge plug.

A packer includes a packer element along with a packer upper tubular and a packer lower tubular along with a body on which the packer element is mounted.

The packer can be permanent or temporary. Temporary packers are normally retrievable and are run with a string and so removed with the string. Permanent packers on the other hand, are normally designed to be left in the well (though they could be removed at a later time).

The annular sealing device may be wirelessly controlled.

A sealing portion of the annular sealing device may be elastomeric, non-elastomeric and/or metallic.

Connector

The connector is a mechanical connection (as opposed to a wireless connection) and may comprise, at least in part, a tubular connection for example some lengths of tubing or drill pipe. It may include one or more of perforation guns, gauge carriers, cross-overs, subs and valves. The connector may comprise or consist of a threaded connection. The connector does not consist of only wireline, and normally does not include it.

Normally the connector comprises a means to connect to the annular sealing device, such as a thread or dogs.

The connector may be within the same casing that the annular sealing device is connected to.

The connector may comprise a plug, for example, in the tubing (which is separate from the annular sealing device, which may also comprise a plug).

Deployment

The apparatus may be deployed with the annular sealing device or after the annular sealing device is provided in the well following an earlier operation. In the former case, it may then be provided on the same string as the annular sealing device and deployed into the well therewith. In the latter case, it may be retro-fitted into the well and moved past the annular sealing device. In this latter example, it is normally connected to a plug or hanger, and the plug or hanger in turn connected directly or indirectly, for example by tubulars, to the annular sealing device. The plug may be a bridge plug, wireline lock tubular/drill-pipe set barrier, shut-in tool or retainer such as a cement retainer. The plug may be a temporary or permanent plug.

Also, the apparatus may be provided in the well and then an annular sealing device deployed and set thereabove and then the method described herein performed after the annular sealing device is run in.

The container may be sealed at the surface, and then deployed into the well. 'At surface' in this context is typically outside of the well although it could be sealed whilst in a shallow position in the well, such as up to 30 metres from the surface of the well, that is the top of the uppermost casing of the well. Thus the apparatus moves from the surface and is positioned below the annular sealing device with the container sealed before moving the valve member. Depending on the deployment method it may be run in with the annular sealing device already thereabove or move past the previously installed annular sealing device.

In the first aspect of the invention, the entire apparatus is below the annular sealing device, as opposed to a portion of the apparatus.

The port of the apparatus may be provided within 100 m of a communication path between the well and the reservoir, optionally 50 m or 30 m. If there is more than one communication path, then the closest communication path is used to determine the spacing from the port of the apparatus. Optionally therefore, the port in the container may be spaced below communication paths in the well. This can assist in drawing debris away from the communication path(s) to help clear them.

Such embodiments can complement one known procedure for starting a well, when a valve is opened at the time the guns fire, and the well (rather than the container) is in an underbalanced condition. The surge of fluids from the well can then clear some communication paths as the well starts to flow. However, this tends to clear the upper communication paths more than lower communication paths. Accordingly performing a method as described herein can assist in clearing the lower communication paths, especially when the apparatus is positioned below the communication paths. Moreover, embodiments described herein can assess the effectiveness of the perforating operation, and then can be activated in response to this, for example to clear communication paths which are relatively blocked.

In certain embodiments, the apparatus may be run on a tubular string, such as a test, completion, suspension, abandonment, drill, tubing, casing or liner string. Alternatively, the apparatus may also be conveyed into the well on wireline or coiled tubing (or a tractor). The apparatus may be an integral part of the string.

The apparatus is typically connected to a tubular before it is operated. Therefore whilst it may be run in by a variety of means, such as wireline or tubing, it is typically connected to a tubular such as production tubing or casing when in the well, before it is operated. This provides flexibility for various operations on the well.

The connection may be by any suitable means, such as by being threaded, gripped, latched etc onto the tubular. Thus normally the connection between the tubular takes some of the weight of the apparatus, albeit this would not necessarily happen in horizontal wells.

The apparatus may be provided towards or at the lowermost end of a lowermost casing or liner. The container may be defined, at least in part, by the casing or liner. Therefore the lowermost part of the container may be within 100 m of the bottom of the well and indeed may be the bottom of the casing.

The string may be deployed as part of any suitable well operation, including drilling, well testing, shoot and pull, completion, work-over, suspension and/or abandonment operation.

The string may include perforating guns, particularly tubing conveyed perforating guns. The guns may be wirelessly activatable such as from said wireless signals.

A plurality of apparatus described herein may be run on the same string. For example spaced apart and positioned within one section or isolated sections. Thus, the apparatus may be run in a well with multiple isolated sections adjacent different zones. In such a scenario, there may not be straightforward access below guns to the lower section(s). Thus when run with such a string, embodiments of the invention provide means to manipulate such a section. For example, when the port of the apparatus is isolated from the surface of the well, flow may continue from a separate zone of the well, which is not in pressure communication with the port, and not isolated from the surface of the well.

The apparatus may be dropped off an associated carrying string after the valve member has been opened or for any other reason (for example it is not required and is not possible or useful to return it to surface). Thus it is not always necessary to return it to the surface.

A variety of arrangements of the apparatus in the well may be adopted. The apparatus may be positioned substantially in the centre of the well. Alternatively, the apparatus may be configured as an annular tool to allow well flow through the inner tubular, therefore, the container is formed in an annular space between two tubes and the well can flow through the inner tube.

In other embodiments, the apparatus can be offset within the well, for example attached/clamped onto the outside of a pipe, or mounted offset within a pipe. Thus it can be configured so apparatus or other objects (or fluid flow) can move through the bore of the pipe without being impeded. For example it may have a diameter of 1¾ inches offset inside a 4" inner diameter outer pipe. In this way, one or more wireline apparatus can still run past it, as can fluid flow.

For certain embodiments, the apparatus may be deployed in a central bore of a pre-existing tubular in the well, rather than into a pre-existing annulus in the well. An annulus may be defined between the apparatus and the pre-existing tubular in the well.

The method may be used to clear or extend communication paths.

The apparatus may be run into the well as a permanent apparatus designed to be left in the well, or run into the well as a retrievable apparatus which is designed to be removed from the well.

Optionally the port of the apparatus may be isolated from a surface of the well.

The entire apparatus, and not just the port of the apparatus, may be isolated from the surface of the well.

Isolating the port of the apparatus from the surface of the well means preventing pressure or fluid communication between the port and the surface of the well.

Isolation can be achieved using the well infrastructure and isolating components. Isolating components comprise packers, plugs such as bridge plugs, valves, and/or the apparatus.

Thus the annular sealing device is normally an isolating component and along with other isolating components and well infrastructure, can isolate the port of the apparatus from the surface of the well. In certain embodiments therefore, more than one isolating component can isolate the port of the apparatus from the surface of the well. For example, a packer may be provided in an annulus and a valve provided in a central tubing and together they isolate the port of the apparatus from the surface of the well. In such cases the uppermost extent of the well section that contains the port of the apparatus is defined by the uppermost isolating component.

In contrast, well infrastructure comprises cement in an annulus, casing and/or other tubulars.

Isolating the port of the apparatus from the surface of the well involves isolating the section of the well containing the port downhole, such that the uppermost isolating component in that isolated well section is at least 100 m from the surface of the well, optionally at least 250 m, or at least 500 m.

The port of the apparatus is typically at least 100 m from the uppermost isolating component in the same section of the well. In certain embodiments, the port of the apparatus is at most 500 m from the uppermost isolating component in the same section of the well, optionally at most 200 m therefrom.

The well or a section thereof may be shut in downhole before the apparatus has been operated.

The step of isolating the port of the apparatus from the surface of the well may include shutting in at least a section of the well. For example the well can be shut in above the port of the apparatus, which isolates the port of the apparatus from the surface of the well.

For other embodiments at least a section of the well can be shut in separate to this isolating step, for example, below the apparatus, or the well may have been shut in at an earlier date.

Isolating the port of the apparatus from the surface of the well, and optionally shutting in the well, can reduce the volume exposed to the apparatus which then focuses the effect of the underbalanced container to the intended area.

Well Conditions

Outside the container is generally the surrounding portion of the well. The surrounding portion of the well, is the portion of the well surrounding the apparatus, especially outside the port, immediately before the valve member is moved in response to the control signal.

When the valve member is in the position to allow for fluid entry into said portion of the container for a sufficient period of time (which may be less than a second), the pressure between a portion of the inside of the container and an outside of the container such as the surrounding portion of the well (especially the portion of the well at the port) may equalise, in the absence of other forces. Nevertheless, for certain embodiments, the valve member may be moved into the first or a further, closed position before the pressure has equalised.

Outside the container may also be the formation, for example, via a communication path. Thus for certain embodiments, such as a short interval procedure, the effect of the reduced pressure in the container primarily effects the formation rather than the well.

The well may contain well fluids especially in the surrounding portion of the well. The well may additionally or alternatively contain a kill fluid especially in the surrounding portion of the well. For example, where the well has been temporarily or permanently abandoned, it can have an overbalance of well/control fluid in order to contain the well. This can result in pores in the formation being blocked or partially blocked by the kill fluid. Also, there may instead or additionally be remnants of the filter cake, which could also inhibit fluid flow from the reservoir, or for example, pressure pulses during a connectivity test.

Thus when abandoning a well the apparatus may be mounted in the well, for example by a bridge plug, and the wireless signals used to monitor the well. This may be useful for connectivity tests such as interference tests. The apparatus may be used to clear communications path(s) to the adjacent formation (or it may be done in an openhole section) to potentially improve the connectivity with the adjacent formation (for example, by clearing pores in the formation) and therefore potentially improving the data received from such tests. This may be performed on test wells or other wells, and not necessarily those which were put into long term production.

Optionally therefore a barrier, such as a bridge plug or cement barrier, is provided in the well to temporarily or permanently abandon the well, and the apparatus is provided therebelow and can be used to, for example, clear perforations to facilitate connectivity tests and communicate wirelessly, especially with EM or acoustic signals, to retrieve data.

In alternative embodiments, the barrier can comprise the annular sealing device along with for example a valve.

Gas Well

In certain scenarios in a gas well, certain lower communication paths may be restricted from flowing by a liquid sitting across the well, whilst gas is produced from above this liquid. The pressure below the liquid is not sufficient to overcome the hydrostatic head of the liquid and gas thereabove. Accordingly gas flow from said lower communication paths may be stopped. Embodiments of the present invention may be used to draw in fluid including some of this liquid from the well into the container to reduce the hydrostatic head in such a scenarios, and encourage recovery of gas from the lower communication paths.

Manipulating may include altering pressure, assisting well to flow and capturing fluids. The method to manipulate a well can be a method to at least partially clear the well optionally in preparation for a test.

Thus according to a further aspect of the present invention there is provided a method to conduct a procedure or test on a well, comprising:

- conducting the method to manipulate the well, as described herein;
- conducting a procedure/test on the well, the procedure/test includes one or more of image capture, a build-up test, drawdown test, connectivity test such as a pulse test or interference test, flow test, pressure test, drill stem test (DST), extended well test (EWT), well/reservoir treatment such as an acid treatment, interval injectivity test, permeability test, hydraulic fracturing, minifrac procedure, injection procedure, gravel pack operation, perforation operation, string deployment, workover, suspension and abandonment.

The test is normally conducted on the well before removing the apparatus from the well, if it is removed from the well.

Embodiments of said further aspect may improve the pressure or fluid communication across the face of the formation, and hence improve the performance of the tests.

The apparatus may be provided below a barrier and a negative pressure test carried out from therebelow, when fluid is drawn in. Thus such embodiments can more effectively test well barriers from the side of the plug where it is more difficult to conduct such a test.

Below said (first) barrier, there may be a second barrier. For example the first barrier may be a cement barrier i.e. comprise or consist of cement, and the second barrier may comprise a bridge plug, and a negative pressure test may be performed on both barriers.

The method to conduct a test/procedure on the well may also include perforating the well. However, the method of the present invention is normally independent from operation of the perforating devices such as guns. The well may be openhole and/or pre-perforated.

The apparatus may be used to clear the surrounding area before images are captured.

The method of the invention can improve the reliability and/or quality of data received from subsequent testing.

The procedure may be a drill stem test (DST). Thus a DST string and the annular sealing device are deployed as part of the DST. After the final DST flow period or build up has been conducted, a valve controlling flow into the DST test string is closed. The valve is normally below the annular sealing device though for certain embodiments it may be thereabove. The valve may be controlled by said wireless signals. The portion of the DST string above the valve (often above the annular sealing device) can then, optionally, be removed. The well below the annular sealing device can then be monitored as described herein. Notably the underbalanced container may be activated when required, such as at a much later date. Moreover, communication paths below the annular sealing device between the well and the reservoir need not have been contaminated by kill fluid, and so better connectivity with the reservoir can be maintained, providing more useful data when conducting tests such connectivity tests. If the well is abandoned by cementing above the annular sealing device (and normally adding a further barrier) the wireless signals may still be used to monitor the well below the annular sealing device. Data recovery before during or after the apparatus being activated is normally achieved through wireless signals.

In some embodiments, kill fluid may be present inside tubing in the well above the annular sealing device before the apparatus is activated.

Miscellaneous

The well may be a subsea well. Wireless communications can be particularly useful in subsea wells because running cables in subsea wells is more difficult compared to land wells. The well may be a deviated or horizontal well, and embodiments of the present invention can be particularly suitable for such wells since they can avoid running wireline, cables or coiled tubing which may be difficult or not possible for such wells.

References herein to perforating guns includes perforating punches or drills, all of which are used to create a flowpath from the reservoir to the well.

The volume of the container is its fluid capacity.

Transceivers, which have transmitting functionality and receiving functionality; may be used in place of the transmitters and receivers described herein.

Unless indicated otherwise, any references herein to "blocked" or "unblocked" includes partially blocked and partially unblocked.

All pressures herein are absolute pressures unless stated otherwise.

The well is often an at least partially vertical well. Nevertheless, it can be a deviated or horizontal well. References such as "above" and below" when applied to deviated or horizontal wells should be construed as their equivalent in wells with some vertical orientation. For example, "above" is closer to the surface of the well through the well.

A zone is defined herein as a formation adjacent to or below the lowermost barrier or annular sealing device, or a portion of the formation adjacent to the well which is isolated in part between barriers or annular sealing devices and which has, or will have, at least one communication path (for example perforation) between the well and the surrounding formation, between the barriers or annular sealing devices. Thus each additional barrier or annular sealing device set in the well defines a separate zone, except areas between two barriers or annular sealing devices (for example a double barrier) where there is no communication path to the surrounding formation and none are intended to be formed.

"Kill fluid" is any fluid, sometimes referred to as "kill weight fluid", which is used to provide hydrostatic head typically sufficient to overcome reservoir pressure.

References herein to cement include cement substitute. A solidifying cement substitute may include epoxies and resins, or a non-solidifying cement substitute such as Sandaband™.

Embodiments of the present invention will now be described, by way of example only, with reference to the accompanying figures in which.

Figure 1:
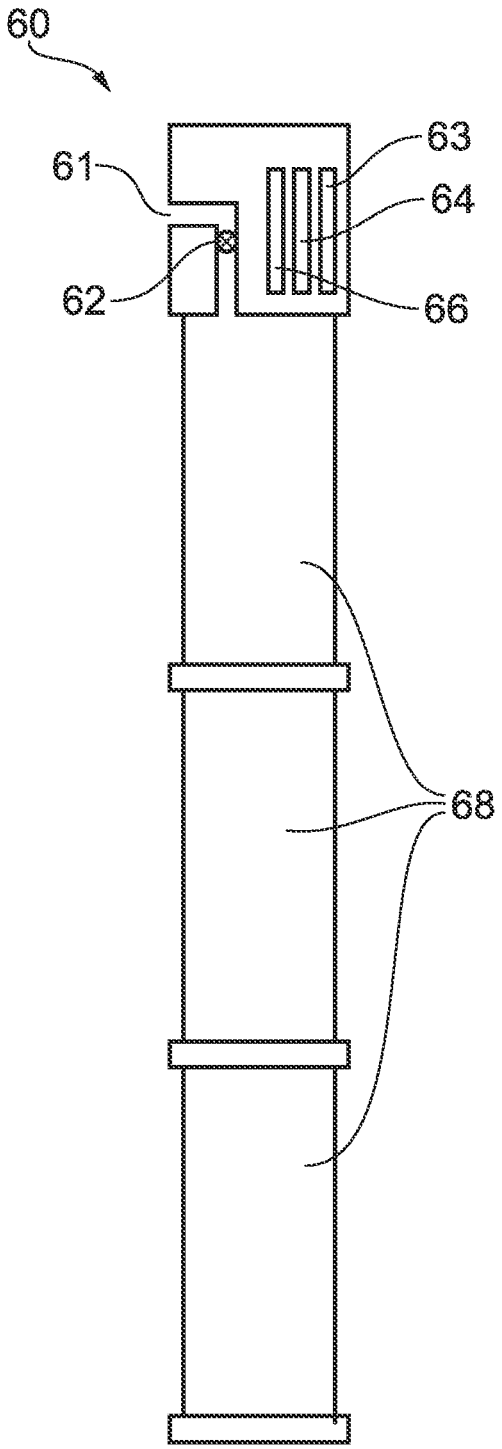
FIG. 1 is a schematic view of a first apparatus which may be used in the method of the present invention.

FIG. 1 shows the apparatus 60 in accordance with the present invention in the form of a modified pipe formed from three (or more) lengths of drill pipe and comprising a side opening 61, a valve 62, a control mechanism comprising a valve controller 66 and a wireless receiver (or transceiver) 64, a battery 63 and a container 68 with a volume capacity of, for example, 1000 litres. There is an underbalance (for example 1000 psi) of pressure between the container 68 and a surrounding portion of a well. (The breadths of the apparatus here and in other figures have been exaggerated for ease of illustration.)

A battery 63 is provided in the apparatus 60 which serves to power components of the apparatus 60 for example the valve controller 66 and the transceiver 64. Often a separate battery is provided for each powered component.

The apparatus 60 also comprises a valve 62. The valve 62 is configured to isolate the opening 61 to seal the container 68 from the surrounding portion of the well in a closed position and allow pressure and fluid communication between a portion of the container 68 and the surrounding portion of the well via the side opening 61 in an open position.

The valve 62 is controlled by the valve controller 66. The transceiver 64 is coupled to the valve controller 66 which is configured to receive a wireless control signal. In use, the valve 62 is moved from the closed position to the open position in response to the control signal.

The components of the control mechanism (the transceiver 64 and the valve controller 66 which controls the valve 62) are normally provided adjacent each other, or close together as shown; but may be spaced apart.

In some embodiments, the container 68 is filled with a gas, such as air, initially at atmospheric pressure. In such embodiments, the gas is sealed in the container at the surface before being run into the well to create an underbalance of pressure between the container and the surrounding portion of the well (which is at a higher pressure than atmospheric pressure on the surface).

Figure 2:
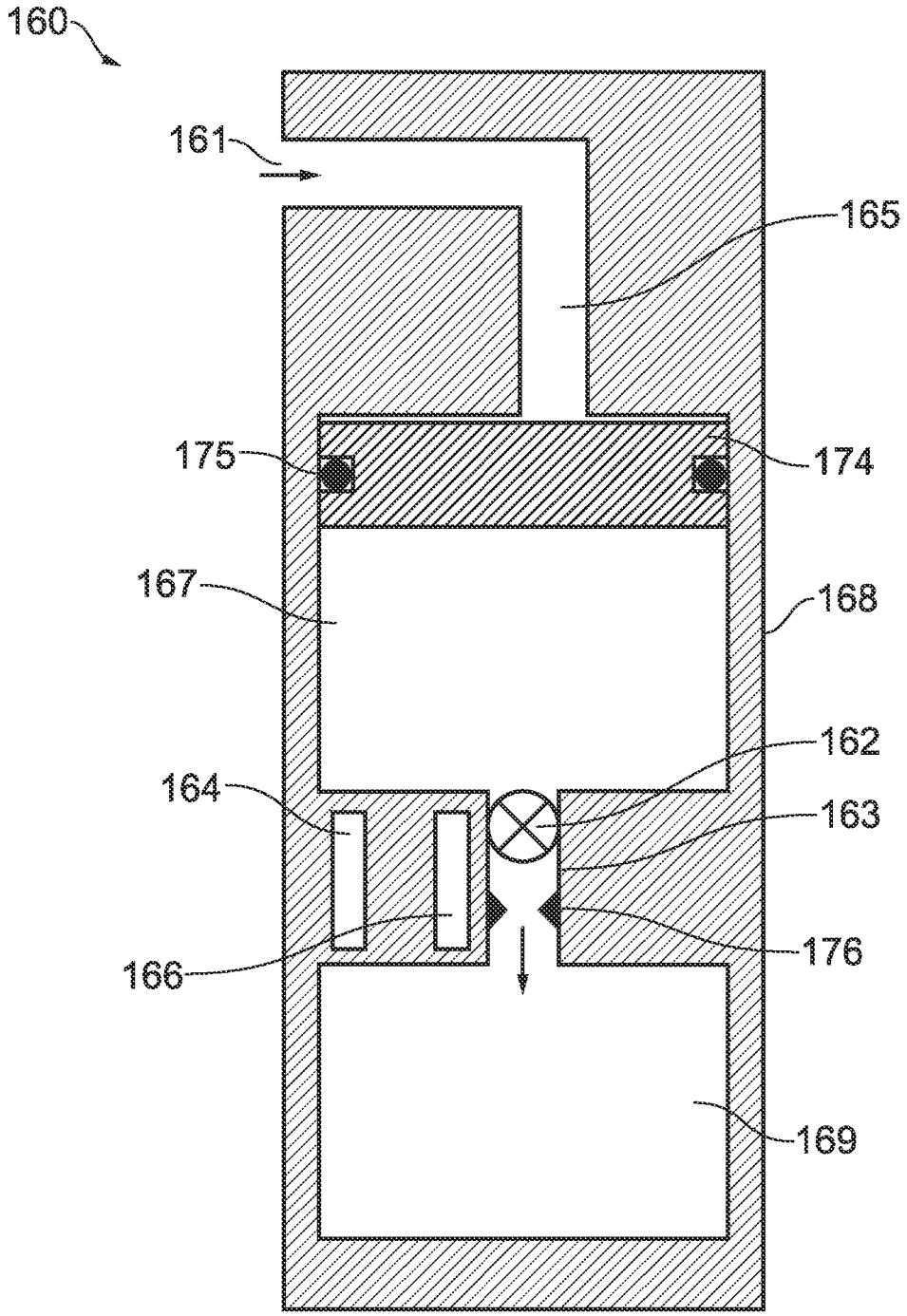
FIG. 2 is a schematic view of a second apparatus including a floating piston and a choke insert which may be used in a method in accordance with the present invention.

FIG. 2 shows an embodiment of the apparatus 160. Like parts with the FIG. 1 embodiment are not described in detail but are prefixed with a '1'. Whilst not illustrated, the apparatus 160 may also be formed from adjoined drill pipe as illustrated in FIG. 1. However, in contrast to the embodiment shown in FIG. 1, FIG. 2 shows an embodiment of an apparatus 160 wherein a control valve 162 and a choke 176 are located in a central portion of the apparatus in a port 163 between two sections of the container 168—a fluid chamber 167 and a dump chamber 169.

The floating piston 174 is located in the container 168 above the control valve 162. The fluid chamber 167 is initially filled with oil below the piston 175 through a fill port (not shown).

In the present embodiment the floating piston 174 functions as the valve assembly having a valve member to allow or resist fluid entry into the fluid chamber 167 of the container 168. When the floating piston 174 is located at the top of the fluid chamber 167 it isolates/closes the fluid chamber 167 from the surrounding portion of the well, and when the floating piston 174 is located at the bottom of the fluid chamber 167 the opening 161 allows fluid to enter the fluid chamber 167 via flow port 165 from outside of the container, normally the surrounding portion of the well. The location of the floating piston 174 is controlled indirectly by the flow of fluid through the control valve 162, which is in turn controlled via signals sent to a valve controller 166.

In use, the sequence begins with the control valve 162 in the closed position and the floating piston 174 located towards the top of the fluid chamber 167. Due to an underbalance of pressure (for example 1000 psi) in the dump chamber 169 of the container 168, the fluid in the well attempts to enter the fluid chamber 167 via the opening 161 but is resisted by the floating piston 174 and oil therein whilst the control valve 162 is in the closed position. A signal is then sent to the valve controller 166 instructing the control valve 162 to open. Once the control valve 162 opens, oil from the fluid chamber 167 is directed into the dump chamber 169 by the well pressure acting on the floating piston 174, and fluids from the surrounding portion of the well are drawn into the fluid chamber 167. The rate at which the oil in the fluid chamber 167 is expelled into the dump chamber 169, and consequentially the rate at which the fluids from the well can be drawn into the container 168, is controlled by the cross-sectional area of the choke 176. In alternative embodiments, the choke 176 and control valve 162 positions can be in the opposite order to that illustrated, or may be combined. Indeed the control valve 162 can be at the port 161, albeit it is preferred to have the choke 176 between the fluid chamber 167 and dump chamber 169. In this way, the choke 176 and oil regulates the flow of fluid into the fluid chamber 167 irrespective of the properties, such as the density or viscosity, of the well fluids.

This embodiment is particularly suited for flow tests or short interval tests (see FIG. 5) where flow in a controlled manner is desirable.

Figure 3:
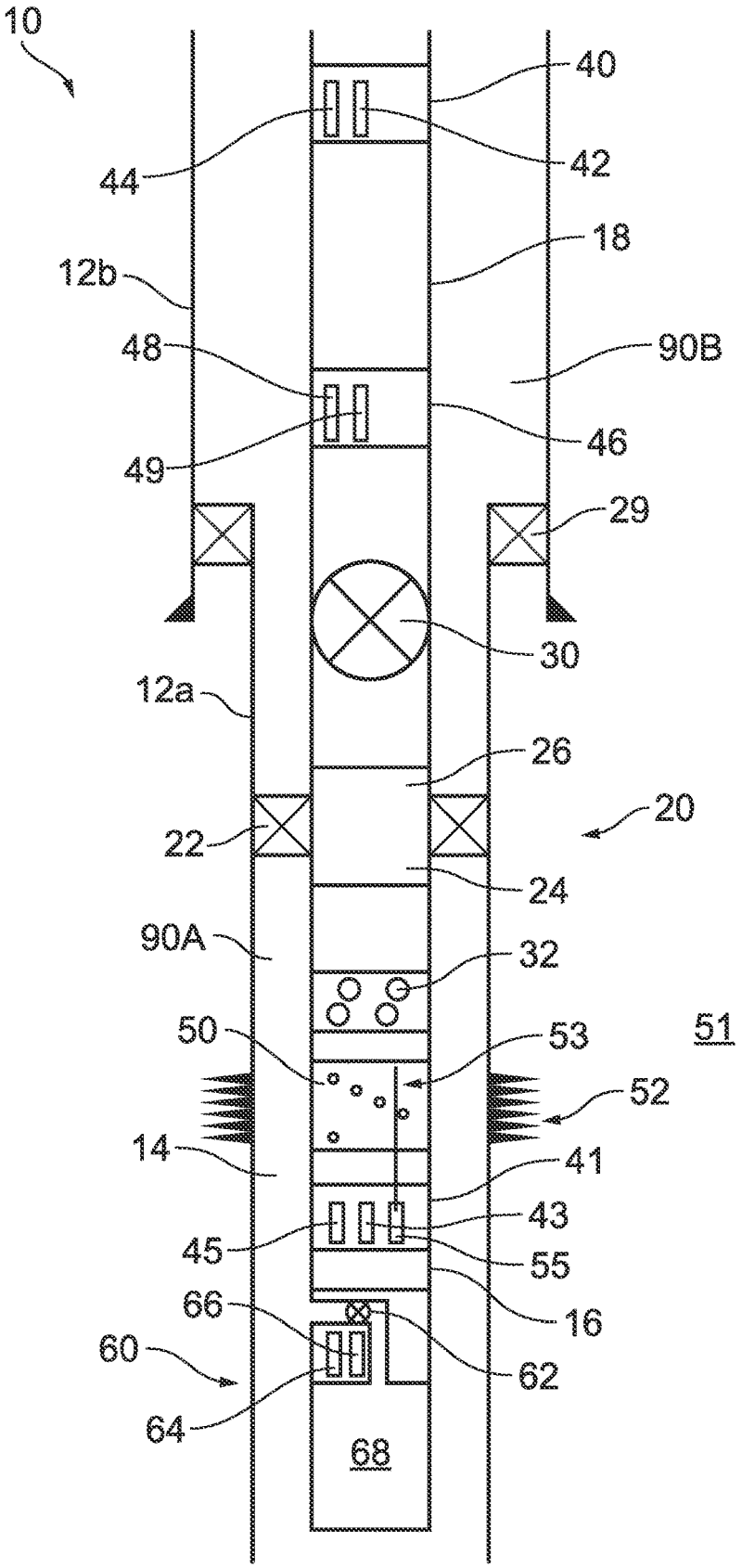
FIG. 3 is a schematic view of a well illustrating a method in accordance with an embodiment of the present invention.
Figure 4:
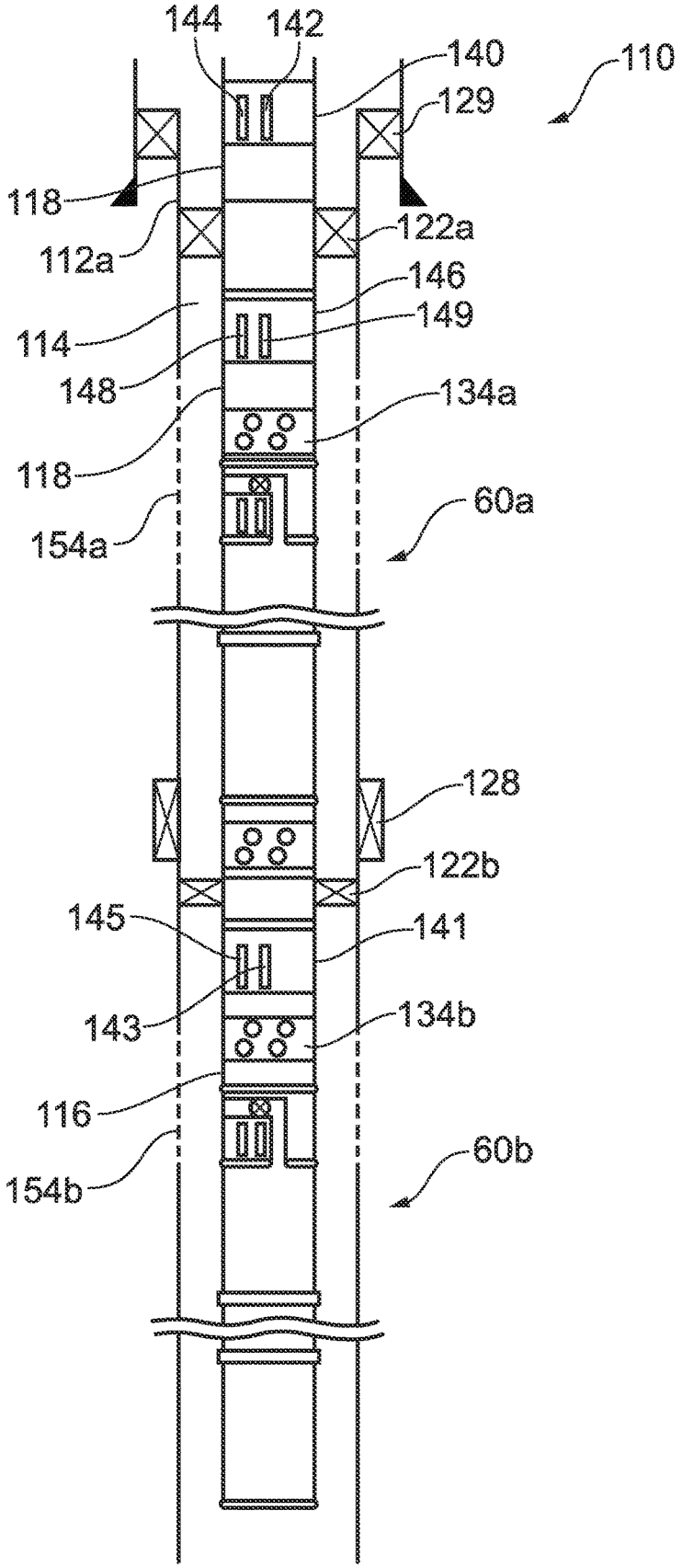
FIG. 4 is a schematic view of a well with multiple zones, illustrating another aspect of the present invention.

FIG. 3 and FIG. 4 shows the apparatus 60 of FIG. 1 positioned in a well and activated to draw in fluid in order, for example, to attempt to clear debris from a local area.

FIG. 3 shows a well 14 with well apparatus 10 including an annular sealing device having a packer element 22 provided between the well and upper 18 and lower 16 tubulars. The tubulars 16, 18 have a longitudinal bore and extend below and above the packer element 22, which is one type of annular sealing device. The tubing 16 and perforating gun 50 serve as a connector to connect the apparatus 60 to the annular sealing device.

The well apparatus 10 also includes an apparatus 60 below the packer element 22. The apparatus 60 and other like parts have been previously described in FIG. 1.

The well apparatus 10 can be used during a drill stem test (DST). The apparatus 60 is activated prior to the DST and after perforating guns 50 have created perforations 52 in the lower tubular 16. Once the perforations 52 have been created, there is often debris in the well 14 which could inhibit the flow of fluids and potentially block, or partially block, the communication paths, such as perforations, between the well 14 and the reservoir 51. The container 68 is underbalanced, therefore opening the valve 62 causes a surge of fluid into the container 68. It is an advantage of certain embodiments of the present invention that the apparatus 60 is activated after creating the perforations to help clear the well of debris, thus helping to mitigate the problem of a blocked, or partially blocked, communication path, which could inhibit flow and so compromise the accuracy of data from the DST.

This embodiment of the invention will now be described in more detail.

The illustrated well 14 is a substantially vertical well comprising liner string 12*a* and a casing string 12*b*. Inside each of the liner/casing strings 12*a*, 12*b* there is an annulus 90A & 90B respectively. The well 14 includes a liner hanger 29. The liner hanger 29 is part of a liner hanger assembly from which the liner string 12*a* can be hung.

The liner string 12*a* contains perforations 52 in the lower part of the well 14 which allows well fluids to flow into the well. The packer element 22, along with a packer upper tubular 26 and a packer lower tubular 24, makes up a packer 20.

A perforating gun 50 is provided on the lowermost part of the lower tubular 16 to create perforations 52 in the liner string 12*a*. The perforating gun 50 may be wirelessly activated by wireless signals, independent of activation of the apparatus 60.

The packer 20 is a temporary packer which is run into the well 14 with the tubulars 16, 18 such that it is provided between the liner string 12*a* and the tubulars 16, 18. In use, it is activated to expand and set against the liner string 12*a* to create a longitudinal seal between the tubulars 16, 18 and the A-annulus.

An instrument carrier 41 is provided on the lower tubular 16. The instrument carrier 41 comprises a pressure sensor 43 which is coupled physically and/or wirelessly to a wireless relay 45. The relay 45 comprises a transceiver which can transmit data from below the packer element 22 and send it onwards, such as towards the surface of the well, optionally via relays 44, 48 on further instrument carriers 40, 46 provided on the upper tubular 18. These further instrument carriers 40, 46 also comprise pressure sensors 42, 49 which are coupled to the wireless relays 44, 48. The relays 44, 48 comprise transceivers which can also receive control signals from the surface and send it below the packer element 22 to the transceiver 64 of the valve controller 66, optionally via the wireless relay 45.

A discrete temperature array 53 is provided adjacent to the perforations 52 and connected to a controller 55. In this embodiment the array has multiple discrete temperature sensors along the length of a small diameter tube.

A tester valve 30 is provided in the upper tubular 18 above the packer element 22. The well apparatus 10 further comprises a flow sub 32 which provides a flowpath between the well and the longitudinal bore of the tubulars 16 & 18, and also the tester valve 30.

The tester valve 30 is configured to allow or resist the flow of fluids through the tubular 18. Together with the packer 22, they form isolating components.

The apparatus 60 is located below the packer 20 and also below the perforating guns 50.

The transceiver 64 coupled to the valve controller 66 is configured to receive a wireless control signal, and also to transmit data from the apparatus 60 below the packer element 22 to above the packer element 22.

During a DST, the tester valve 30 can be instructed to close to allow the build-up of pressure in the reservoir and the well 14 beneath the packer element 22. The build-up of pressure can be monitored for useful data. Upon re-opening the tester valve 30, the flow of well fluids can also provide useful data. The data can be indicative of information on reservoir properties, such as the reservoir pressure, and recoverable reserves.

During production or for a DST, after the liner string 12*a* has been perforated by the perforating guns 50, well fluids can flow into the well 14 via the perforations 52 and into the lower tubular 16 via the ports in the flow sub 32. The fluids pass through the lower tubular 16 towards the upper tubular 18 and then continue, via the tester valve 30, towards the surface.

However, after the perforating guns 50 have fired, there is often debris in or around the perforations which could inhibit the flow of fluids to the surface. The apparatus 60 can be used to create a pressure surge into the container 68 to clear the debris before testing or production.

In use, there is an underbalance of pressure between the container 68 and the surrounding portion of the well. After the valve 62 is opened to allow pressure and fluid communication between the portion of the container 68 and the surrounding portion of the well, there is a surge of fluid into the container 68, due to this negative pressure. This rapid drawdown can help to clear debris from the well in the vicinity of the apparatus 60, such as debris from the perforations.

It may also be an advantage of certain embodiments of the present invention that the reliability and/or quality of data received from the well after the debris is cleared is improved, such as during a DST. Furthermore, it may be an advantage of embodiments of the present invention that the pressure connectivity in the well is improved which can subsequently improve the flow rate from the reservoir.

If the well 14 is suspended or abandoned or if specific zone(s) are shut-in after the DST, it is an advantage of certain embodiments to have an apparatus 60 in the well 14, because it can be used to clean the perforations and/or pores of the formation to improve the quality of the data received from monitoring the reservoir. This is especially useful where there is an overbalance of "kill" fluid in the well 14 as this can result in the pores of the formation being blocked, or partially blocked, by sediment which has come out of the fluid. In certain circumstances an operator may kill the well, retrieve the string, and run an observation string with the apparatus 60 and the container 68 but not the guns. In such circumstances, there may be remnants of sediment inhibiting the pressure connectivity from the reservoir and the apparatus 60 can be activated to improve connectivity.

A corrosion sensor may be provided in the well, especially where the well is to be monitored for an extended period of time.

Alternatively, rather than retrieve the string, the apparatus 60 (and optionally other elements of the string) may be left in the well and activated at a later date, for example 6 months later.

For alternative embodiments, the apparatus 60 can be activated at any time not just prior to the DST.

FIG. 4 shows an alternative embodiment of the present invention. Where the features are the same as FIG. 3 they have been labelled with the same number except preceded by a "1". These features will not be described in detail again here.

FIG. 4 shows a well 114 comprising a liner hanger 129 and a liner string 112*a* and two sets of apparatus 60*a* and 60*b*, including the features of the apparatus 60 described in FIG. 1 and FIG. 3. The well 114 also comprises an upper annular sealing device comprising an upper packer element 122*a*, a wirelessly controlled upper sleeve valve 134*a*, an upper apparatus 60*a* as well as the upper slotted liner 154*a*. The well 114 further comprises a lower annular sealing device comprising a lower packer element 122*b*, a wirelessly controlled lower sleeve valve 134*b*, a lower apparatus 60*b* and a lower slotted liner 154*b*. The tubing 118 connects the apparatus 60*a* to the upper annular sealing device, and the tubular 116 connects the apparatus 60*b* to the lower annular sealing device.

Thus this embodiment comprises a multi-zone well 114 with well apparatus 110 which comprises two packer elements 122*a* & 122*b* which splits the well into two sections. The first, upper section comprises the upper packer element 122*a*, the upper sleeve valve 134*a*, the upper apparatus 60*a* and the upper slotted liner 154*a*. The second, lower, section comprises the lower packer element 122*b*, the lower sleeve valve 134*b*, the lower apparatus 60*b* and the lower slotted liner 154*b*.

The slotted liners 154*a*, 154*b* create communication paths between the inside of the liner 154 and the adjacent formation.

The well 114 further comprises a packer such as a swell packer 128 between an outer surface of the liner string 112*a* and a surrounding portion of the formation.

The upper tubular 118 and lower tubular 116 are continuous and connected via the upper packer element 122*a* and the lower packer element 122*b*.

The first and second sections contain well apparatus which is run into the well on the same string, that is on the tubulars 116,118.

Instrument carriers 140, 141 and 146 are provided in each section and also above the packer element 122*a*. Each instrument carrier comprises a pressure sensor 142, 143, and 148 respectively, and a wireless relay 144, 145, and 149 respectively.

Isolating the sections from each other provides useful functionality for manipulating each adjacent zone individually.

In use, the well 114 flows from a lower zone through the lower slotted liner 154*b* and into the lower tubular 116 via the sleeve valve 134*b*. The flow continues through the lower tubular 116 past the lower packer element 122*b*, the upper apparatus 60*a* and instrument carrier 146 before continuing through the upper tubular 118 towards the surface. Thus in contrast to the FIG. 3 embodiment, the apparatus 60*a* is configured to allow flow through the tubing without the need to divert the flow outside thereof, since it does not take up the full bore of the upper tubular 118.

From an upper zone, the well flows through the slotted liner 154*a* and into the upper tubular 118 via the sleeve valve 134*a*. The flow continues through the upper tubular 118, past the upper packer element 122*a* towards the surface.

In use, the flow may be from the upper zone adjacent the well 114 only, the lower zone adjacent the well 114 only or may be co-mingled, that is produced from the two zones simultaneously. For example, fluids from the slotted liner 154*b* combine with further fluids entering the well 114 via the upper slotted liner 154*a* to form a co-mingled flow.

The features of the FIG. 4 embodiment are especially suitable to being used in production, injection, well testing or observation operations. For example, in certain embodiments, the apparatus can be used to help clean the perforations and the pores of the formation prior to flowing the well or after initial flow.

In other embodiments, after a zone has been shut-in or killed it can then be reopened or monitored to perform a connectivity test between the upper and lower zones or other wells. In such embodiments, the apparatus can be used to help clear the communication paths of the "kill" fluid or clear other formation damage.

A pressure gauge can monitor the pressure within the containers. Moreover, the gauges or other devices can be powered by the battery.

In some embodiments, the lower packer element 122*b* is a permanent packer with a polished bore on the inner face which engages with the seals on the tubular 116, and together they form an annular sealing device.

Figure 5:
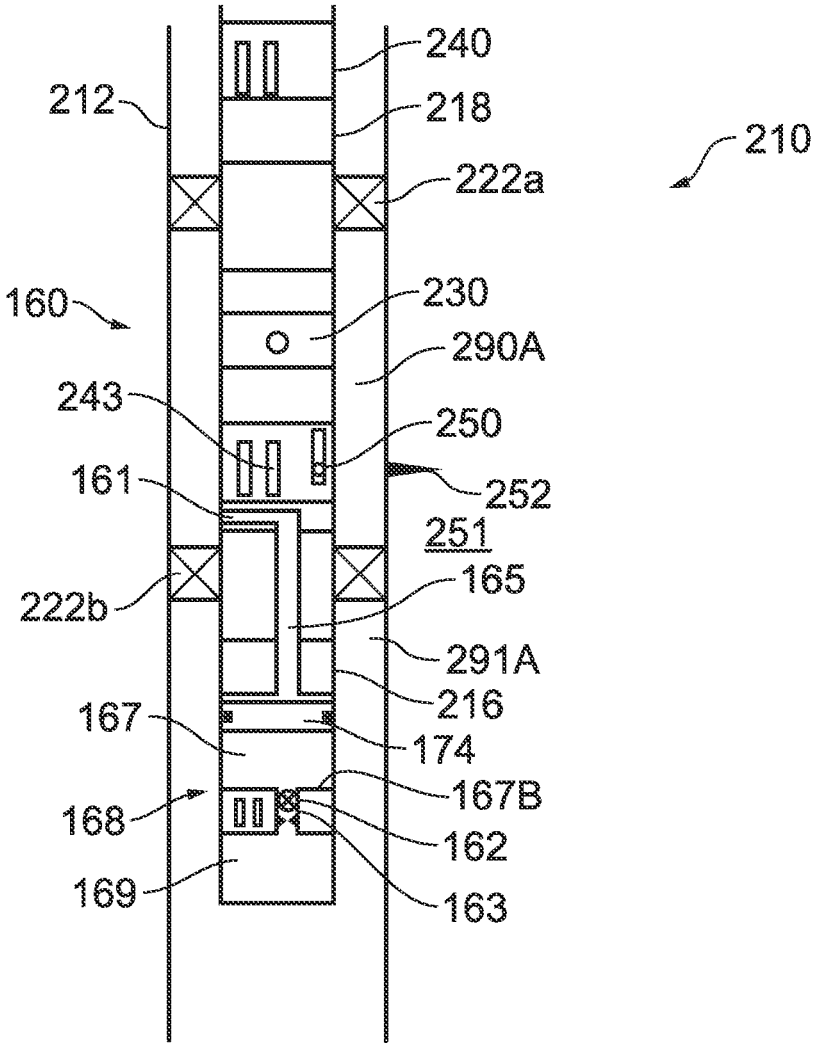
FIG. 5 is a schematic view illustrating an apparatus used in an interval test in accordance with one aspect of the present invention.

FIG. 5 shows such a short interval test using the apparatus 160 as previously described in FIG. 2. Where the well features are the same as previous FIGS. 3 and 4 they have been labelled with the same number except preceded by a "2". These features will not be described in detail again here.

Annular sealing devices in the form of packer elements 222*a* and 222*b* are set in the casing 212, and a perforating tool 250 receives a wireless signal to activate and punch a hole 252 in the casing 212 and adjacent formation 251.

The apparatus 160 then receives a control signal to open the valve 162 and the container 168, which has an underbalanced portion 169, receives flow in a controlled manner from the perforated interval 252 between the two packer elements 222*a* and 222*b*. Pressure is monitored by a pressure sensor 243 before the valve 162 is opened, and as the flow enters the fluid chamber 167 above the floating piston 174. Concurrently a control fluid, such as oil, moves through the valve 162 from the fluid chamber 167 (below the floating piston 174) into the dump chamber 169.

The valve 162 is closed before significant pressure has built up in the dump chamber 169. This maintains a more constant pressure differential between the dump chamber 169 and fluid chamber 167, which in turn provides a more constant flow rate of fluids entering the fluid chamber 167 and so provides more meaningful data.

In alternative embodiments, the valve 162 is not closed, but instead the piston abuts against the lower extent 167B of the fluid chamber 167. For such embodiments, the valve 162 can thus be a relatively simple single-shot valve.

A relatively limited flow test can thus be conducted in the short interval between the packer elements 222*a*, 222*b*. Data from pressure sensors 243 or other sensors in communication with the short interval, such as between the two packer elements 222*a*, 222*b* or below the lower packer element 222*b* in the flow port 165, can provide useful flow test information. This can obviate the need to conduct a time consuming and much more expensive procedure of a full well test, or even a closed chamber test where well fluids are displaced at the surface. Data from the pressure sensor(s) can be transmitted wirelessly, for example by acoustic or electromagnetic signals, to the surface for monitoring.

A variety of alternatives are available for such a flow test of a short interval. Two or more such flow tests can be conducted. In one embodiment, the valve 162 can be opened again and more fluid enters the fluid chamber 167, and this open/close sequence can be repeated until the fluid chamber 167 is full. Alternatively or additionally, further underbalanced containers may be provided to conduct the further flow test. In either case, an operator can unseat the packer elements 222*a*, 222*b*, reposition the apparatus 160, re-seat the packer elements 222*a*, 222*b*, and then conduct a subsequent flow test of a different short interval.

In one alternative embodiment, a pump controls the port 163 (or a further port) between the fluid chamber 167 and the dump chamber 169. This can be operated after the procedure described above, to pump fluid from the dump chamber 169 back into the fluid chamber 167, and the apparatus 160 can be used again. Indeed, for such embodiments, the port 161 can have an outlet to annulus area 291A below the packer element 222*b*. When the control fluid is pumped back into the fluid chamber 167 (below the floating piston 174) the fluid above the floating piston 174, previously taken from the interval, can be exhausted into the annulus area 291A, outwith the interval and below the packer element 222*b*.

As a further option, a second underbalanced container is provided, preferably configured as the container 60 shown in FIG. 1. This can be used to purge the interval, before the apparatus 160 is used to conduct the flow test on the short interval, as described above.

After the short interval test, it may be useful to control the interval by adding 'kill' fluid. Optionally therefore, a sleeve valve 230 can be provided between the tubing string 218 and surrounding annulus 290A which can be opened to allow pressure connectivity between the interval and the string above, for example to allow kill fluid to enter the interval.

The apparatus 60, 160 can be used in a variety of wells and are not limited to the illustrated examples.

Figure 6:
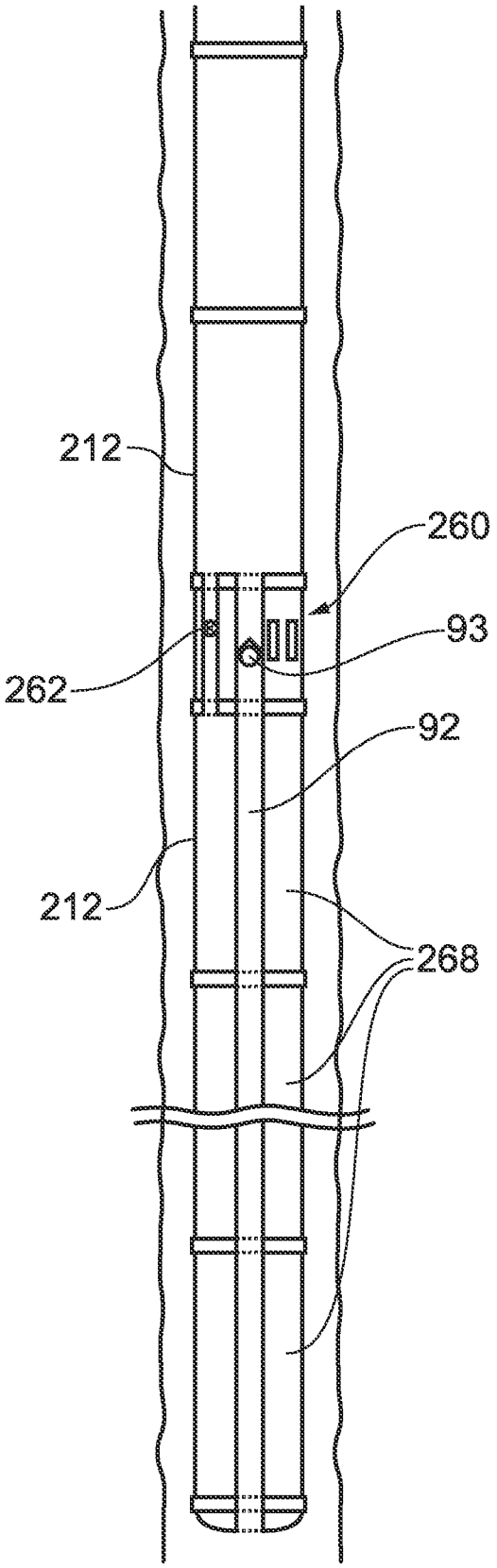
FIG. 6 is a cut-away schematic view of a further embodiment of an apparatus which may be used in the method illustrated in FIGS. 3 and 4; and, FIG. 7 is a front view of an embodiment of a valve assembly for use with the various apparatus whilst conducing the method in accordance with the present invention.

In FIG. 6, an alternative embodiment of an apparatus 260 with a container 268 is illustrated. Common features with earlier embodiments are not described again for brevity. In contrast to earlier figures the container 268 with a valve 262 is in part defined by the surrounding casing 212. Such an apparatus 260 is normally run on the casing 212 when completing the well. An advantage of such an embodiment is that the container can have larger volumes without running further tubing into the well. The apparatus 260 may have flow bypass 92 controlled by a pump 93 for cementing during completion. Such embodiments are useful for clearing a toe of a horizontal well.

Moreover, embodiments can be used to clear liquid, such as water, from a gas well. In certain situations, a gas well produces from an upper zone, or section of a zone and a liquid column resists gas production from a lower zone, or section of a zone which has insufficient pressure to overcome the combined hydrostatic head of the liquid column and pressure of the upper zone, or section of a zone. The liquid column is thus 'trapped' in the well and prevents production from a lower zone, or section of a zone. Certain embodiments of the present invention, such as the FIG. 6 embodiment, can be used to remove a portion of the liquid column to allow the lower zone, or section of a zone to produce.

Figure 7:
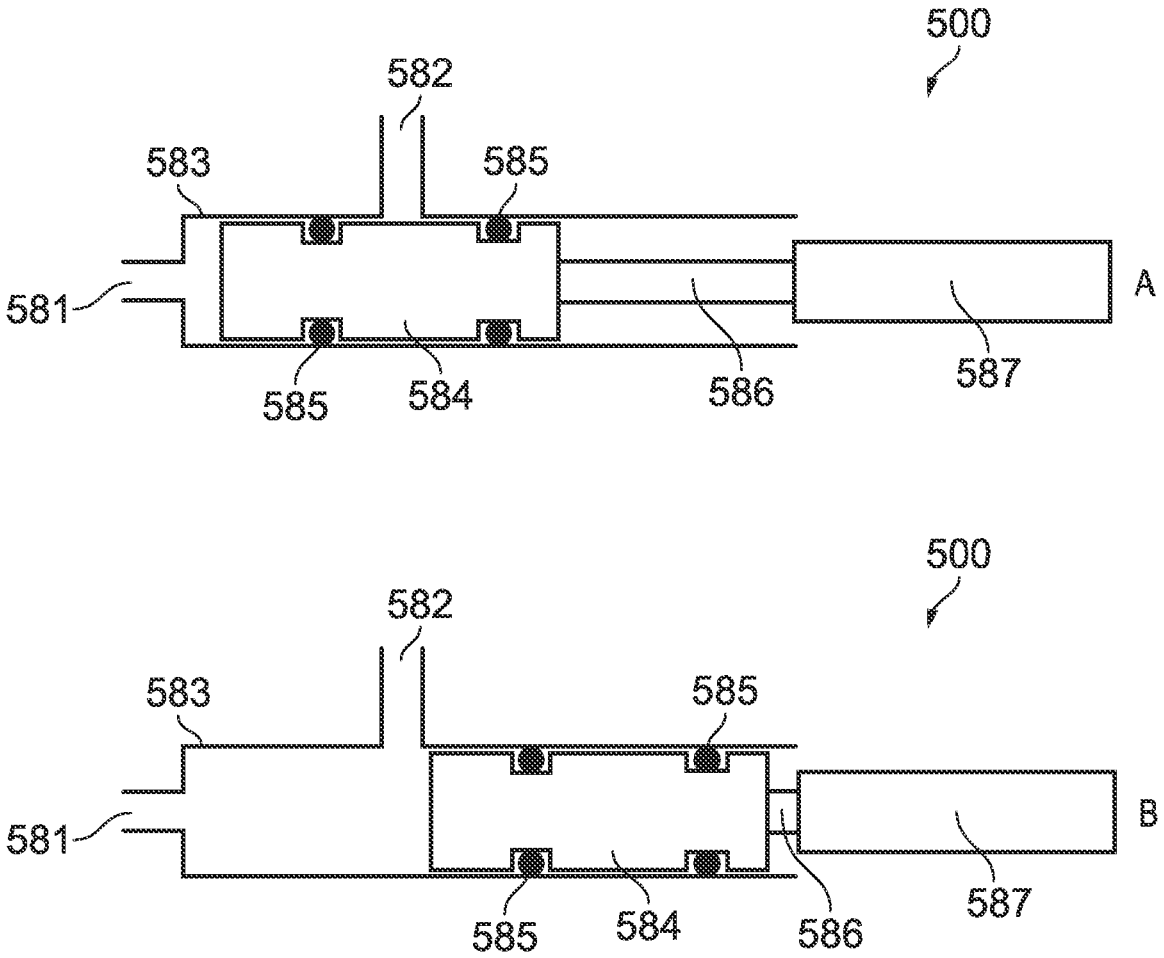

A variety of valves may be used with the apparatus described herein. FIG. 7 shows one example of a valve assembly 500 in a closed position A and in an open position B. The valve assembly 500 comprises a housing 583, a first inlet port 581, a second outlet port 582 and a valve member in the form of a piston 584. The valve assembly further comprises an actuator mechanism which comprises a lead screw 586 and a motor 587.

The first port 581 is the inlet and the second port 582 is the outlet. The first port 581 is on a first side of the housing 583 and the second port 582 is on a second side of the housing 583, such that the first port 581 is at 90 degrees to the second port 582.

The piston 584 is contained within the housing 583. Seals 585 are provided between the piston 584 and an inner wall of the housing 583 to isolate the first port 581 from the second port 582 when the valve assembly 500 is in the closed position A; and also to isolate the ports 581, 582 from the actuator mechanism 586, 587 when the valve assembly is in the closed A and/or open B position.

The piston 584 has a threaded bore on the side nearest the motor 587 which extends substantially into the piston 584, but does not extend all the way through the piston 584. The lead screw 586 is inserted into the threaded bore in the piston 584. The lead screw 586 extends partially into the piston 584 when the valve assembly 500 is in the closed position A. The lead screw 586 extends substantially into the piston 584 when the valve assembly is in the open position B.

In use, the valve assembly is initially in the closed position A. A side of the piston 584 is adjacent to the first port 581 and a top side of the piston 584 is adjacent to the second port 582 so that the first port 581 is isolated from the second port 582. This prevents fluid flow between the first port 581 and the second port 582. Once the actuator mechanism receives a signal instructing it to open the valve, the motor begins to turn the lead screw 586 which in turn moves the piston 584 towards the motor 587. As the piston 584 moves, the lead screw 586 is inserted further into the piston 584 until one side of the piston 584 is adjacent to the motor 587. In this position, the first port 581 and the second port 582 are open and fluid can flow in through the first port 581 and out through the second port 582.

Modifications and improvements can be incorporated herein without departing from the scope of the invention. For example various arrangements of the container and electronics may be used, such as electronics provided in the apparatus below the container.

Alternative embodiments may transmit from the apparatus to the surface without relays, especially those using EM communication. The relays may be provided in other positions in the well such as the casing.

Moreover, whilst the chokes illustrated here are reduced diameter chokes, other forms of chokes can be utilised, for example an extended section with a restricted diameter.

The invention claimed is:

1. A method to manipulate a well, comprising:

providing a pressure sensor in the well;

providing an apparatus in the well below an annular sealing device, the annular sealing device engaging with an inner face of one of a casing and a wellbore in the well, and being at least 100 m below a surface of the well, providing a connector for connecting the apparatus to the annular sealing device, the connector being above the apparatus and below the annular sealing device;

the apparatus comprising:

a container having a volume of at least 50 litres (l);

a port to allow pressure and fluid communication between an inside and an outside of the container;

a mechanical valve assembly having a valve member adapted to move and one of to selectively allow and to selectively resist fluid entry into at least a portion of the container, via the port;

a control mechanism to control the mechanical valve assembly, comprising a communication device configured to receive a control signal for moving the valve member;

sealing the container at the surface, at least a portion of the container being at least one of being evacuated and having at least 85 vol % gas; and then deploying it into the well such that the apparatus moves from the surface into the well below the annular sealing device with the container sealed;

the pressure in at least a portion of said inside of the container being less than said outside of the container for at least one minute prior to moving said valve member;

sending a control signal from above the annular sealing device to the communication device at least in part by a wireless control signal transmitted in at least one of the following forms: electromagnetic and acoustic;

moving the valve member in response to said control signal to allow fluid to enter the container; and, drawing in at least 5 l of fluid into the container caused by the pressure in at least a portion of said inside of the container being less than said outside of the container for at least one minute.

2. A method as claimed in claim 1, wherein the valve member is moved at least two minutes before and/or at least two minutes after, any perforating gun-activation.

3. A method as claimed in claim 1, wherein the pressure sensor is below the annular sealing device and the pressure sensor is coupled to a wireless transmitter and data is transmitted from the wireless transmitter, to above the annular sealing device in at least one of the following forms: electromagnetic and acoustic.

4. A method as claimed in claim 1, wherein a barrier is provided in the well and the port of the apparatus is provided below the barrier when the valve is moved to allow fluid to enter the container.

5. A method as claimed in claim 4, wherein at least a section of the well has been one of suspended and abandoned below the barrier.

6. A method as claimed in claim 1, wherein the apparatus is conveyed on one of tubing, drill pipe and casing/liner, and wherein the apparatus is optionally deployed into the well in the same operation as deploying the annular sealing device into the well.

7. A method as claimed in claim 1, wherein the well is shut in, at one of surface and downhole, after the apparatus has been run and before the valve member moves in response to the control signal.

8. A method as claimed in claim 1, wherein the annular sealing device is a first annular sealing device and the port of the apparatus is provided above a second annular sealing device.

9. A method as claimed in claim 8, including conducting a short interval test and wherein the first annular sealing device and the second annular sealing device are less than 10 m apart, optionally less 5 m, or less than 2m, or less than 1 m, or less than 0.5 m apart.

10. A method as claimed in claim 1, including using the apparatus to conduct one of an interval test, drawdown test, flow test, build-up test, pressure test, and a connectivity test such as one of a pulse and interference test.

11. A method as claimed in claim 1, also comprising conducting a procedure on the well wherein the procedure includes at least one of image capture, a build-up test, drawdown test, connectivity test such as an one of an interference and a pulse test, flow test, pressure test, drill stem test (DST) extended well test (EWT), well/reservoir treatment such as an acid treatment, interval infectivity test, permeability test, hydraulic fracturing or minifrac procedure, injection procedure, gravel pack operation, perforation operation, string deployment, workover, suspension and abandonment.

12. A method as claimed in claim 1, wherein the well is a gas well, and the apparatus is used to draw in fluid from the well into the container to reduce the hydrostatic head of a lower section of a zone.

13. A method as claimed in claim 1, wherein the container comprises a fluid chamber in fluid communication with the port, and a dump chamber and wherein the control mechanism controls fluid communication between the fluid chamber and the dump chamber.

14. A method as claimed in claim 1, wherein the apparatus comprises a choke optionally one of fixed and adjustable.

15. A method as claimed in claim 1, wherein the container has a volume of at least 100 l and at least 100 l of well fluid is drawn into the container.

16. A method as claimed in claim 1, wherein in addition to the container, there is at least one secondary container having a volume of at least 1 l, the at least one secondary container having a control device for controlling communication between an inside and an outside of the secondary container, wherein the control device includes a mechanical valve assembly, and wherein the pressure inside the secondary container is higher than an outside the secondary container.

17. A method as claimed in claim 1, wherein in addition to the container, there is at least one secondary container having a volume of at least 1 l, the at least one secondary container having a control device for controlling communication between an inside and an outside of the secondary container, wherein the control device includes a mechanical valve assembly, and the apparatus comprises a pump which pumps fluid to/from an inside of the at least one secondary container from/to an outside of the secondary container.

18. A method as claimed in claim 1, wherein the control mechanism is configured to be controllable by the control signal more than 24 hours after being run into the well, optionally more than 7 days, more than 1 month, more than 1 year or more than 5 years.

19. A method as claimed in claim 1, wherein the container is defined, at least in part, by one of casing and liner.

* * * * *